US007690777B2

(12) United States Patent
Wada

(10) Patent No.: US 7,690,777 B2
(45) Date of Patent: Apr. 6, 2010

(54) FILTER DEVICE AND LIQUID DROPLET EJECTING DEVICE

(75) Inventor: Tomohiro Wada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 658 days.

(21) Appl. No.: 11/602,546

(22) Filed: Nov. 21, 2006

(65) Prior Publication Data

US 2007/0229633 A1 Oct. 4, 2007

(30) Foreign Application Priority Data

Apr. 3, 2006 (JP) ..... 2006-102254

(51) Int. Cl.
*B41J 2/175* (2006.01)

(52) U.S. Cl. ..... 347/93; 347/87

(58) Field of Classification Search ..... 347/85, 347/86, 87, 93

See application file for complete search history.

(56) References Cited

U.S. PATENT DOCUMENTS 5,546,109 A * 8/1996 Nakano ..... 347/93
6,120,140 A * 9/2000 Hirosawa et al. ..... 347/93
6,736,496 B2 * 5/2004 Hanaoka et al. ..... 347/86
7,192,131 B2 * 3/2007 Gao et al. ..... 347/93

FOREIGN PATENT DOCUMENTS

| | | |
|---|---|---|
| JP | 9-277561 | 10/1997 |
| JP | 10-329330 | 12/1998 |
| JP | 2004-122398 | 4/2004 |

* cited by examiner

*Primary Examiner*—Anh T. N. Vo
(74) *Attorney, Agent, or Firm*—Fildes & Outland, P.C.

(57) ABSTRACT

The present invention provides a filter device including a supply channel where a liquid flows in; a first liquid chamber that is communicated with the supply channel; a second liquid chamber that is communicated with the first liquid chamber; a first discharge channel that is communicated with the second liquid chamber and that discharges the liquid; a first filter that is provided between the first liquid chamber and the second liquid chamber; and a second filter that is provided between the first liquid chamber and the second liquid chamber and whose lower end is positioned higher than a lower end of the first filter.

21 Claims, 21 Drawing Sheets

FIG.5

| # | DESIRED CHARACTERISTIC/CONDITIONS | CONVENTIONAL EXAMPLE | PRESENT INVENTION |
|---|---|---|---|
| 1 | PREVENTS FLOW OF WASTE/ FOREIGN SUBSTANCES TO JS | ○ | ○ |
| 2 | PREVENTS FLOW OF BUBBLES TO JS (DURING EJECTING) | ○ | ○ |
| 3 | LITTLE FLOW RESISTANCE | ○ | ○ |
| 4 | BACK PRESSURE CAN BE APPLIED TO JS (SEALING STRUCTURE) | ○ | ○ |
| 5 | INITIAL FILLING CHARACTERISTIC IS HIGH | × | ○ |
| 6 | REFILLING CHARACTERISTIC IS HIGH | × | ○ |
| 7 | NOT MANY RESIDUAL BUBBLES IN FU | △ | ○ |
| 8 | BUBBLES NOT ABLE TO FLOW INTO JS WHEN SUCTIONING INK | × | ○ |
| 9 | BUBBLES GATHERED IN FU CAN BE EASILY DISCHARGED | ○ | ○ |
| 10 | BUBBLES DO NOT MIX IN FROM NOZZLES DURING INK CIRCULATION | ○ | ○ |
| 11 | RECOVERY CHARACTERISTIC RECOVERING FROM ABNORMAL CONDITIONS IS HIGH | △ | ○ |
| 12 | INK DISCHARGING FROM INSIDE FU IS EASY (EASILY CLEANED) | × | ○ |
| 13 | CAN BE STORED IN A STATE WHERE INK IS FILLED IN FU | ○ | ○ |
| 14 | SIZE OF OUTER FORM (MOUNT AREA) IS SMALL | △ | ○ |
| 15 | CAN BE MANUFACTURED AT LOW COST | ○ | ○ |
| 16 | EASY TO ASSEMBLE | ○ | ○ |
| 17 | COMPONENTS' RESISTANCE TO INK IS HIGH | ○ | ○ |
| 18 | COMPONENTS' ABILITY TO BLOCK OUT GASES IS HIGH | ○ | ○ |

○:GOOD △:ACCEPTABLE ×:FAILED 910
916
926
924
912 914
930
930A
K

FILTER DEVICE AND LIQUID DROPLET EJECTING DEVICE

BACKGROUND

1. Technical Field

The present invention relates to a filter device and to a liquid droplet ejecting device. More specifically, the present invention relates to a filter device that removes wastes and foreign substances from inside a liquid, and to a liquid droplet ejecting device that ejects the liquid, which is passed through the filter device and is supplied thereto, from the nozzles of a liquid droplet ejecting head.

2. Related Art

A filter is provided in an inkjet recording device that ejects ink droplets from the nozzles of an inkjet recording head and prints on a recording medium. This filter is provided in the ink supply path of the inkjet recording head in order to prevent clogging of the nozzles or deterioration of the ink ejecting capabilities, due to wastes and/or foreign substances found in the ink.

With recent inkjet recording heads, there is a trend towards an increase in the number of nozzles provided in one recording head, or an increase of repeat-frequency of ejecting of ink, for the purpose of high-speed printing. Also, progress is being made in making the nozzle cross-sectional area smaller in order to make the ejected ink droplets smaller, for the purpose of achieving high-quality printing.

Due to these developments, certain qualities are demanded of the above-mentioned filter, namely, the filter needs to be able to remove even smaller wastes and foreign substances, and it must have a form with which loss of pressure is small. For this reason, progress is being made in the miniaturization of the filter meshes and the increasing of the area of the filter. However, when the filter area is made larger, the size of the inkjet recording head is increased depending on the arrangement of the filter. As a way of improving on this, increases in size of the inkjet recording head can be suppressed by dividing a filter into plural filter portions and being arranged in parallel.

Nonetheless, with the above-described configuration, the channel at the downstream side of the filter branches into plural channels so when bubbles generated in the ink stop in one channel, ink flows in the other channels so sufficient external force cannot be applied to the bubbles. There is a problem in that the ability to remove bubbles (i.e., discharge them) from the channel where the bubbles stop worsens and this tends to cause deterioration of the ink ejecting capability.

SUMMARY

According to an aspect of the present invention, there is provided a filter device including a supply channel where a liquid flows in; a first liquid chamber that is communicated with the supply channel; a second liquid chamber that is communicated with the first liquid chamber; a first discharge channel that is communicated with the second liquid chamber and that discharges the liquid; a first filter that is provided between the first liquid chamber and the second liquid chamber; and a second filter that is provided between the first liquid chamber and the second liquid chamber and whose lower end is positioned higher than a lower end of the first filter.

BRIEF DESCRIPTION OF THE DRAWINGS

Exemplary embodiments of the present invention will be described in detail with reference to the following figures, wherein:

FIG. 5 is a chart comparing the capabilities of the filter unit of FIG. 1 with those of a conventional filter unit with various conditions;

FIG. 10A is a cross-sectional drawing A-A from FIG. 10B and FIG. 10B is a cross-sectional drawing B-B from FIG. 10A;

FIG. 13A is a cross-sectional drawing of A-A from FIG. 13B

DETAILED DESCRIPTION

Hereafter, the first exemplary embodiment of the present invention will be explained while referring to the figures.

Figure 1:
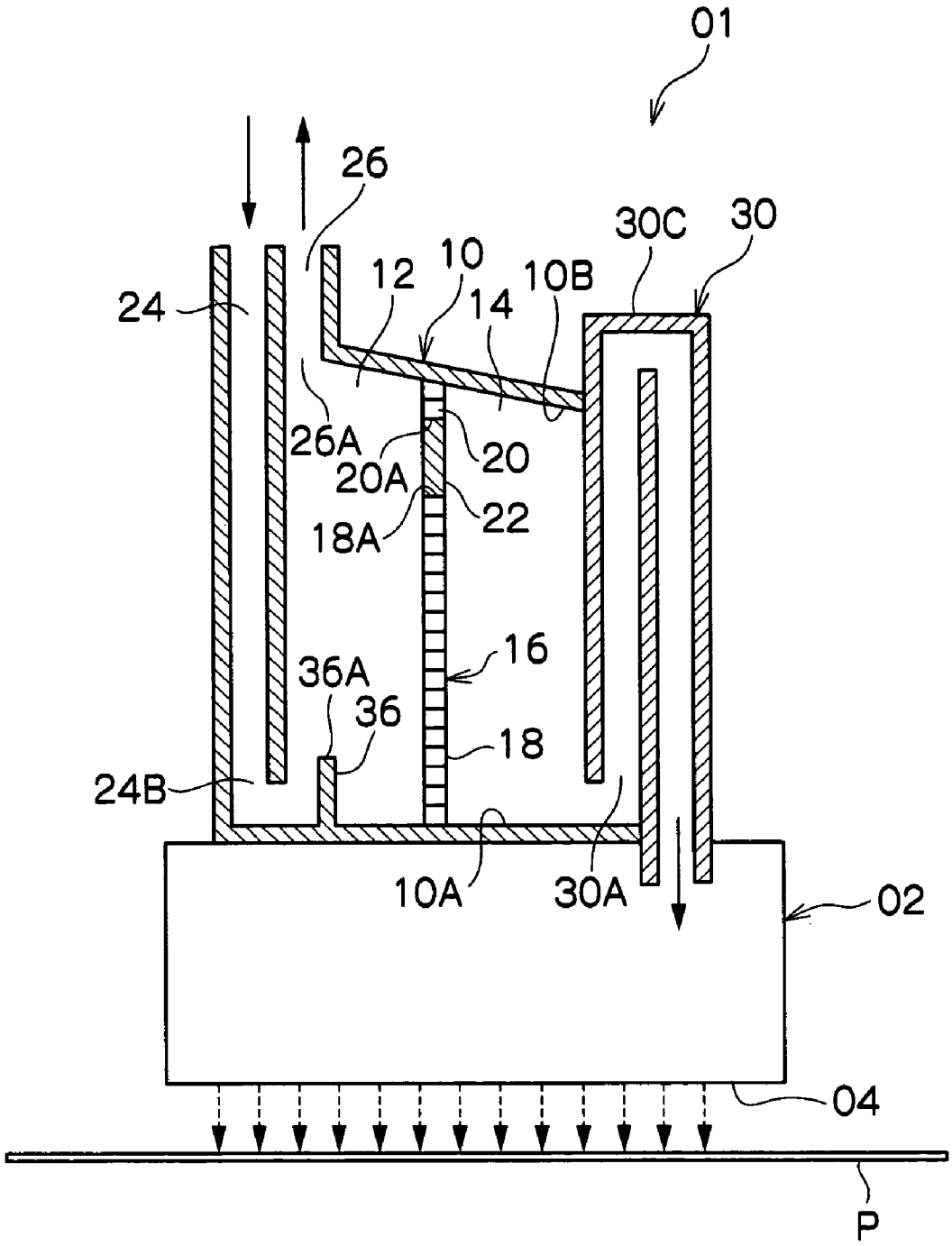
FIG. 1 is a drawing that shows a typical configuration of a filter unit according to a first exemplary embodiment of the present invention, and a typical view of the main components of an inkjet recording device in which this filter unit is used.

As shown in FIG. 1, a filter unit 10 is provided in a inkjet recording device 01 in an ink channel between an ink tank that acts as a liquid accumulation unit (not shown in the drawings)

and an inkjet recording head 02. The inkjet recording head 02 ejects ink droplets (indicated in the drawings with the dotted arrows) from nozzles (not shown) formed in a nozzle surface 04 onto a recording paper P that is a recording medium, and forms an image on the recording paper P.

The filter unit 10 is provided with a first ink chamber 12 and a second ink chamber 14. The first ink chamber 12 and the second ink chamber 14 are partitioned by a filter 16 provided between them.

The first ink chamber 12 and the second ink chamber 14 are partitioned by the filter 16 provided from a bottom 10A up to a ceiling 10B, so the filter 16 is configured to be arranged substantially perpendicularly to the nozzle surface 04 where the nozzles of the inkjet recording head 02 are formed. For this reason, even if the surface area of the filter 16 is increased, the projection area to the nozzle surface 04 does not become larger.

The filter 16 includes a lower filter 18 and an upper filter 20, and a divider 22 is provided between the lower filter 18 and the upper filter 20 them. The divider 22 is positioned slightly below the ceiling 10B. The lower filter 18 and upper filter 20 are arranged to line up top to bottom on the same vertical surface. Note that a lower end 20A of the upper filter 20 is higher than an upper end 18A of the lower filter 18.

With the present embodiment, filter-meshes of a part of one sheet of filter member are embedded with resin and the like to make the divider 22. In this manner, the filter 16 made from the lower filter 18, upper filter 20 and divider 22 is made (refer also to FIG. 20).

Note that the filter 16 can be made such that the lower filter 18 and upper filter 20 are attached above and below the dividing portion provided as a separate component made from a material such as resin.

An ink supply channel 24 and an ink circulation channel 26 are communicated with the first ink chamber 12, and an ink sending channel 30 is communicated with the second ink chamber 14. Then, the ink from an ink tank (not shown in the drawings) is supplied from the ink supply channel 24, and after passing through the first ink chamber 12, the filter 16 and the second ink chamber 14, the ink is sent to the inkjet recording head 02 from the ink sending channel 30. Also, the ink of the first ink chamber 12 can circulate from the ink circulation channel 26 to the ink tank.

A supply channel exit 24B of the ink supply channel 24 opens at the upper vicinity of the bottom 10A. Also, a rectifier 36 is provided so as to stand from the bottom 10A between the ink supply channel 24 and the filter 16. An upper portion 36A of the rectifier 36 extends upwards higher than the supply channel exit 24B of the ink supply channel 24. Also, a circulation channel entrance 26A of the ink circulation channel 26 opens at the ceiling 10B.

The entire ink sending channel 30 is formed in an upside down U-shape. A sending channel entrance 30A of the ink sending channel 30 opens in the vicinity above the bottom 10A. The cross-sectional area of the ink sending channel 30 is between 3 $mm^2$ or more and 12 $mm^2$ or less.

The ceiling 10B is an inclined surface that rises from the second ink chamber 14 towards the direction of the first ink chamber 12, and the circulation channel entrance 26A of the ink circulation channel 26 opens at the highest position thereof.

Further, the height of a convex shaped protruding top portion 30C of the ink sending channel 30 (at the uppermost position of the ink sending channel 30) is higher than the circulation channel entrance 26A of the ink circulation channel 26.

Figure 2:
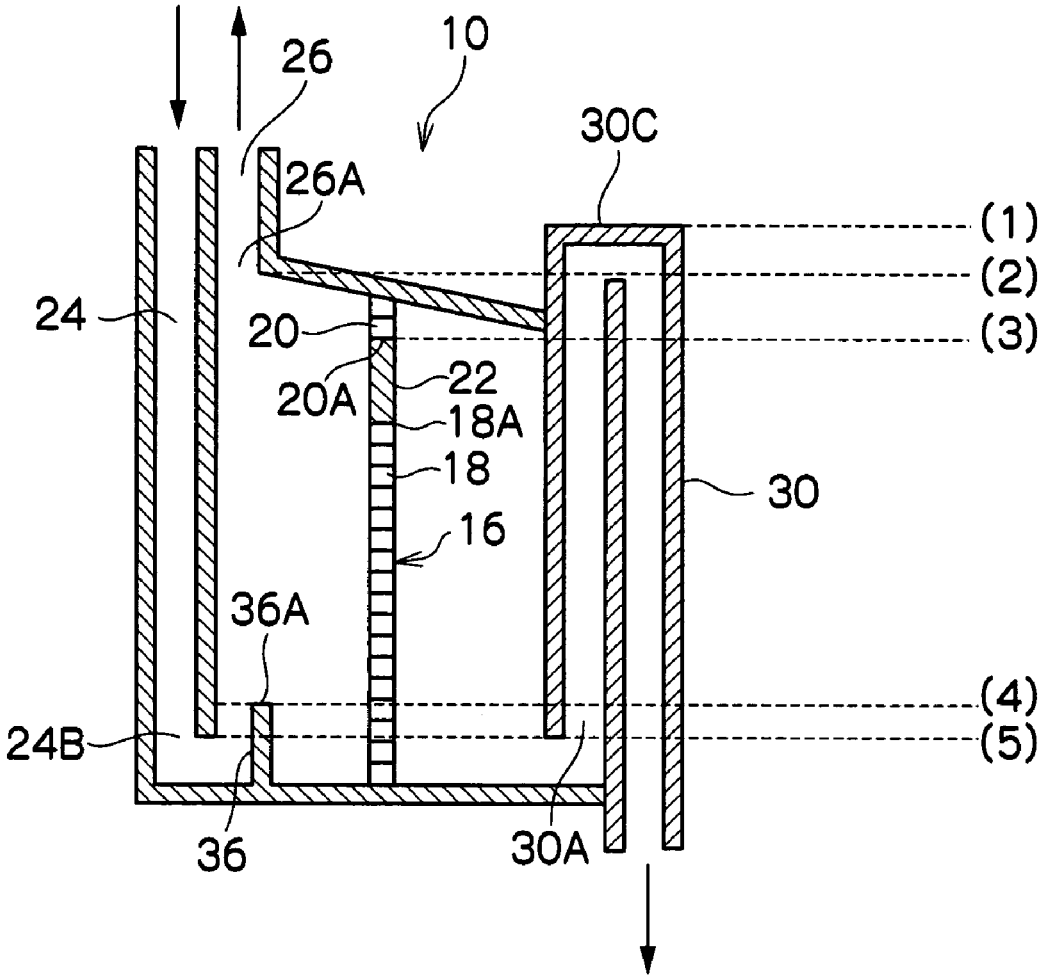
FIG. 2 is a drawing that shows a typical structure of a filter unit according to the first exemplary embodiment of the present invention.

Accordingly, as shown in FIG. 2, the components are arranged in order of height where (1) the convex shaped protruding top portion 30C of the ink sending channel 30 is higher than (2) the circulation channel entrance 26A of the ink circulation channel 26 that is higher than (3) the lower end 20A of the upper filter 20; and much further down, (4) the upper portion 36A of the rectifier 36 is higher than (5) the supply channel exit 24B of the ink supply channel 24, and the supply channel exit 24B is at the same height as the sending channel entrance 30A of the ink sending channel 30.

Next, the operation of the present embodiment will be explained.

First, a conventional filter device will be explained in order to make a comparison with the first exemplary embodiment of the present invention. In this conventional device, there is no failure to discharge bubbles in the channel at the downstream side of the filter even if the surface area of the filter is increased.

Figure 14:
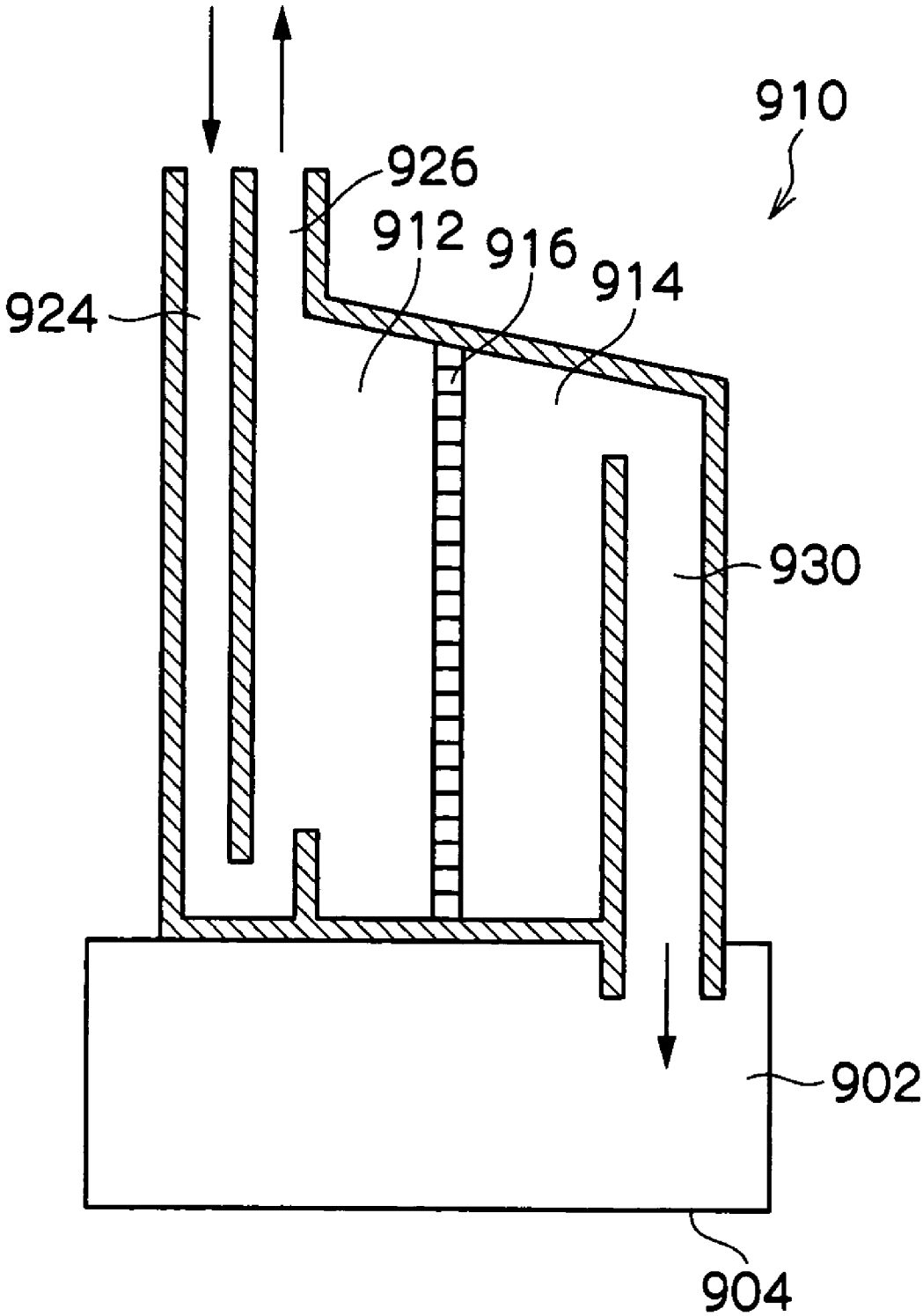
FIG. 14 is a drawing showing a typical structure of a conventional filter unit.

FIG. 14 is a drawing that shows a typical and simplified filter unit (filter device).

As shown in FIG. 14, a filter unit 910 is provided in an ink channel between an ink tank (not shown in the drawings) and an inkjet recording head 902. The inkjet recording head 902 ejects ink droplets from nozzles (not shown in the drawings) formed in a nozzle surface 904 onto a recording paper that is a recording medium, and forms an image on the recording paper.

The filter unit 910 is provided with a first ink chamber 912 and a second ink chamber 914. One sheet of filter 916 divides between the first ink chamber 912 and the second ink chamber 914.

The ink supply channel 924 and an ink circulation channel 926 are communicated with the first ink chamber 912, and an ink sending channel 930 is communicated with the second ink chamber 914. The ink from the ink tank (not shown in the drawings) is supplied from the ink supply channel 924 and sent from the ink sending channel 930 to the inkjet recording head 902. Also, the ink of the first ink chamber 912 can circulate to the ink tank from the ink circulation channel 926.

Note that the first ink chamber 912 corresponds to the outer chamber and the second ink chamber 914 corresponds to the inner chamber.

First, discharging of the air when first filling in ink to the filter unit 910 will be explained using FIGS. 15A-15H.

Figures 15A, 15B, 15C, 15D, 15E, 15F, 15G, 15H:
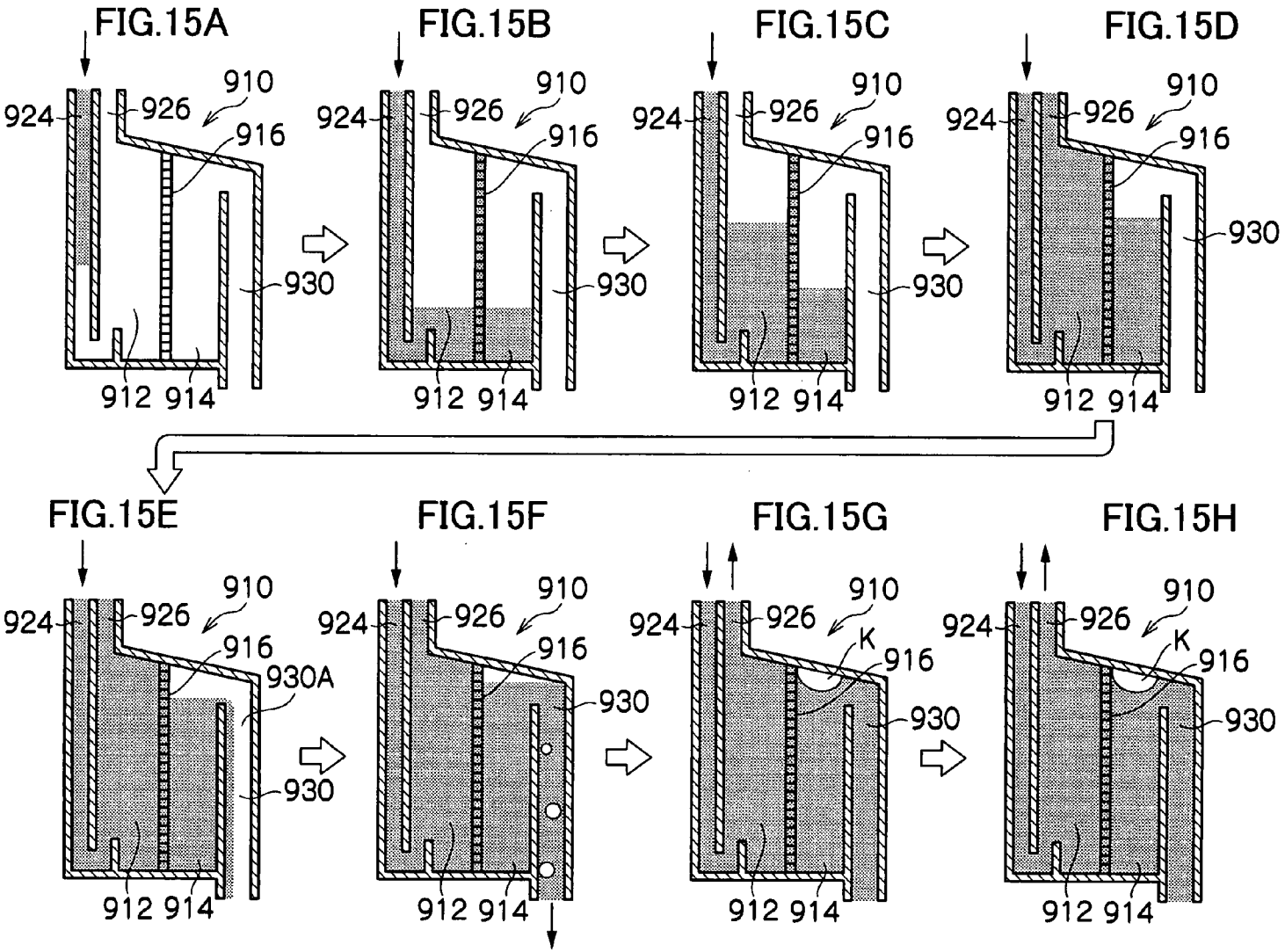
FIGS. 15A-15H are drawings that show when ink is filled to the conventional filter unit of FIG. 14 in the order from 15A to 15H.

As shown in FIGS. 15A and 15B, ink is injected in from the ink supply channel 924 to the first ink chamber 912 and the ink gradually fills the first ink chamber 912 and the second ink chamber 914.

At this time, when the bottom end of the filter 16 that isolates the first ink chamber 912 from the second ink chamber 914 is immersed in ink, the ink soaks into the filter 916 due to capillary action and spreads towards the upper portion thereof. Then, before the first ink chamber 912 and the second ink chamber 914 are filled with ink, the entire surface of the filter 916 is in a state where it is wet with ink.

When the entire surface of the filter 916 is wet with ink, the entry and exit of air between the first ink chamber 912 and the second ink chamber 914 through the filter 916 is obstructed. For this reason, it becomes impossible to discharge the air in the second ink chamber 914 through the ink circulation channel 926. Accordingly, the air inside the second ink chamber 914 can only be discharged through the inkjet recording head 902 that exhibits great discharging resistance.

For this reason, as shown in FIG. 15C, the liquid surfaces of the first ink chamber 912 and second ink chamber 914 that were, until that point, maintained at an even level each other, then become uneven. And, the first ink chamber 912 that discharges air from the ink circulation channel 926 having little resistance fills with ink precedingly.

As shown in FIG. 15D, when the first ink chamber 912 fills with ink, injection of the ink into the second ink chamber 914 resumes.

Then, as shown in FIG. 15E, when the liquid surface reaches up to the height of a sending channel entrance 930A of the ink sending channel 930, ink is discharged from the ink sending channel 930 and the supplying of ink to the inkjet recording head 902 is initiated.

Note that at this time, the cross-sectional area of the ink sending channel 930 is large so the ink is transmitted down the wall surface of the ink sending channel 930 (like a waterfall) and flows into the inkjet recording head 902. Put differently, ink flows into the inkjet recording head 902 in a state where a meniscus is not formed.

For this reason, as shown in FIG. 15F, ink is sent to the inkjet recording head 902 in a state where ink and air are mixed together.

Further, as shown in FIG. 15G, a large amount of air K stays (remains) at the ceiling portion of the second ink chamber 914. It is difficult for the air K to move to the first ink chamber 912 because of the filter 916 so it continues to stay in the second ink chamber 914.

Figure 16:
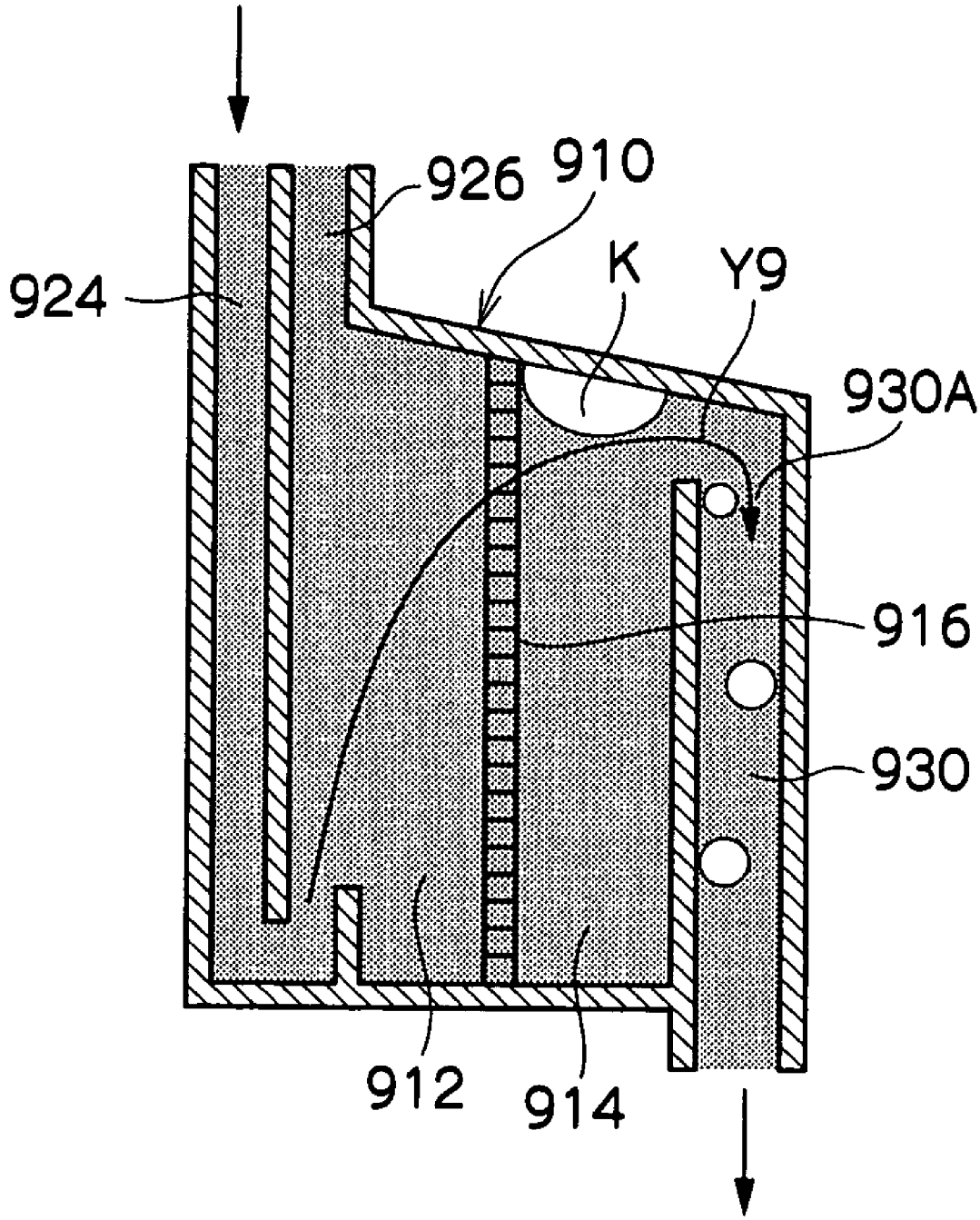
FIG. 16 is a drawing showing the flow of ink in the conventional filter unit of FIG. 14 filled with ink.

As shown in FIG. 16, the sending channel entrance 930A of the ink sending channel 930 opens at the ceiling portion vicinity so the residual air K is in the vicinity of the sending channel entrance 930A. For this reason, when there is ink-suctioning action and the like where ink is suctioned by the nozzles of the inkjet recording head 902, there are cases where, due to ink flowing as indicated with the Y9 arrow, the residual air turns into tiny bubbles and then these bubbles can enter the ink sending channel 930 from the sending channel entrance 930A and flow into the inkjet recording head 902.

With regard to the first exemplary embodiment of the present invention, the discharging of air when first filling the filter unit 10 with ink (i.e., the initial filling) will be explained using FIGS. 3A-3H.

Figures 3A, 3B, 3C, 3D, 3E, 3F, 3G, 3H:
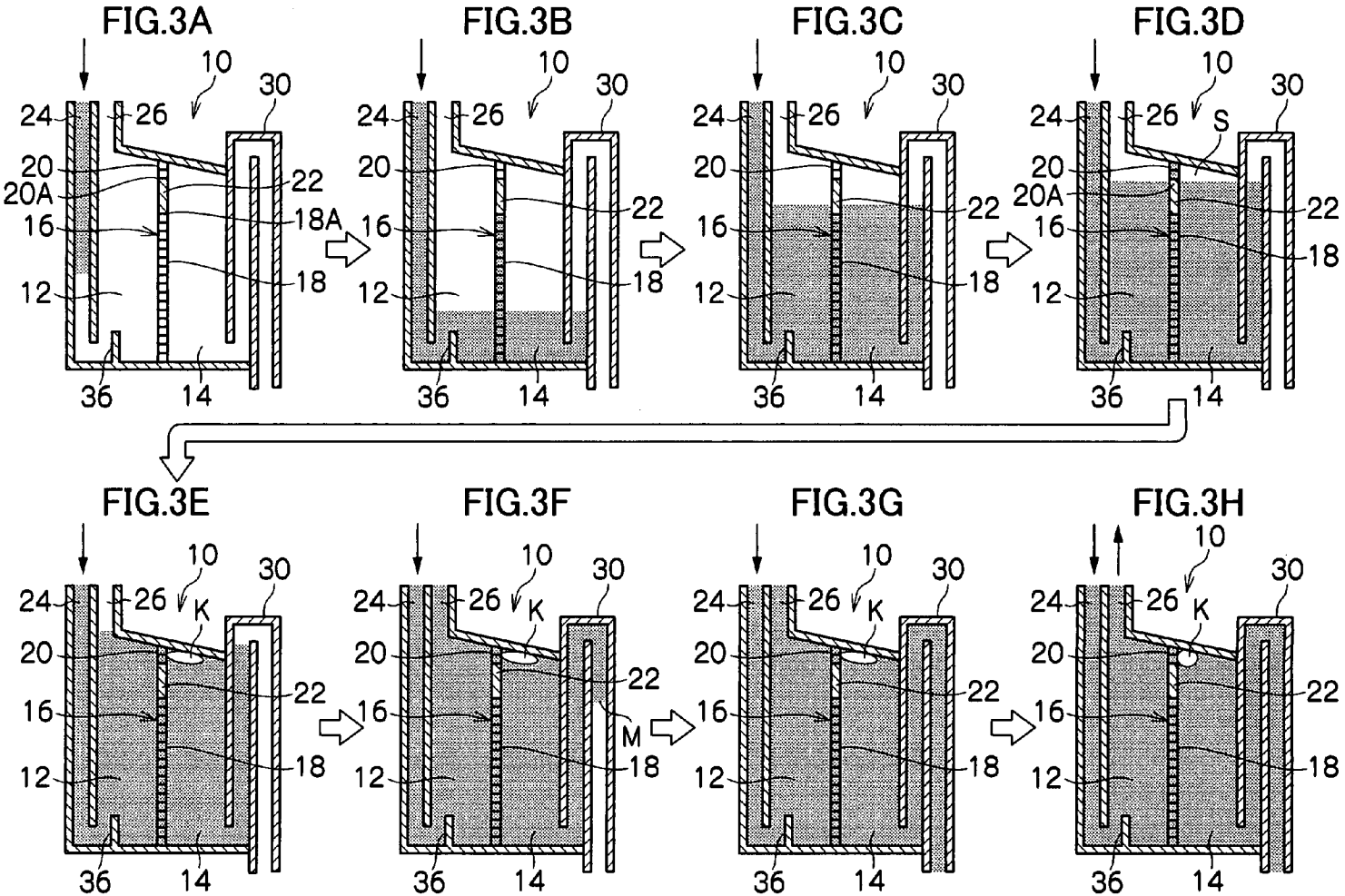
FIGS. 3A-3H are drawings that shows when ink is filled to the filter unit of FIG. 1 in the order from 3A to 3H.

As shown in FIGS. 3A and 3B, the ink is injected into the first ink chamber 12 of the filter unit 10 from the ink supply channel 24, and ink gradually begins to fill the first ink chamber 12 and second ink chamber 14.

At this time, when the bottom end of the filter 16 that isolates the first ink chamber 12 from the second ink chamber 14 becomes immersed in ink, the ink soaks into the filter 16 due to capillary farce and spreads towards the upper portion thereof. However, the filter 16 consists of the upper filter 20 and the lower filter 18 and the divider 22 is provided between them. Accordingly, the lower filter 18 is soaked with ink, however, the soaking and spreading of the ink is stopped at the divider 22 so the upper filter 20 is maintained in a state where it is not wet. For this reason, air can enter and exit between the first ink chamber 12 and the second ink chamber 14 via the upper filter 20, so the air inside the second ink chamber 14 is discharged from the ink circulation channel 26 via the first ink chamber 12.

Accordingly, as shown in FIG. 3C, the first ink chamber 12 and the second ink chamber 14 gradually fill in a state where the same level of liquid surfaces is maintained. Also, ink fills the ink sending channel 30 so that the interior thereof is in a state where a liquid surface level substantially the same as the first ink chamber 12 and second ink chamber 14 is maintained. Note that the discharging resistance for the air is greater at the ink sending channel 30 connected to the inkjet recording head 02 (refer to FIG. 1) than at the ink circulation channel 26. The air inside the ink sending channel 30 escapes through the inkjet recording head 02 so the liquid surface thereof is slightly lower than that of the first ink chamber 12 and second ink chamber 14.

As shown in FIG. 3D, when the liquid surface of the ink surpasses the divider 22 and reaches the bottom end of the upper filter 20, the ink soaks in due to capillary force and spreads towards the upper portion of the upper filter 20. Before the first ink chamber 12 and the second ink chamber 14 are filled with ink, the entire surface of the upper filter 20 is in a state where it is wet with ink. It is then at this time that flow of air between the first ink chamber 12 and the second ink chamber 14 is blocked for the first time.

However, as shown in FIG. 3E, the second ink chamber 14 is already sufficiently filled with ink at this time and the amount of air K remaining in the second ink chamber 14 is extremely small (refer to FIGS. 3E and 15E for comparison).

As shown in FIG. 3F, when the first ink chamber 12 and second ink chamber 14 are filled with ink, the supplying of ink from the ink sending channel 30 to the inkjet recording head 02 is initiated. At this time, the cross-sectional area of the ink sending channel 30 is between 3 $mm^2$ or more and 12 $mm^2$ or less so the ink is sent with the ink meniscus M maintained as is. For this reason, ink is injected into the inkjet recording head 02 in a state where almost no air is mixed therein. (Refer to FIGS. 3E, 3F and 3G and FIGS. 15E and 15F for comparison.) Further, as shown in FIGS. 3G and 3H, only a very small amount of air K remains.

Next, the flow of the ink after filling will be explained.

Figure 4:
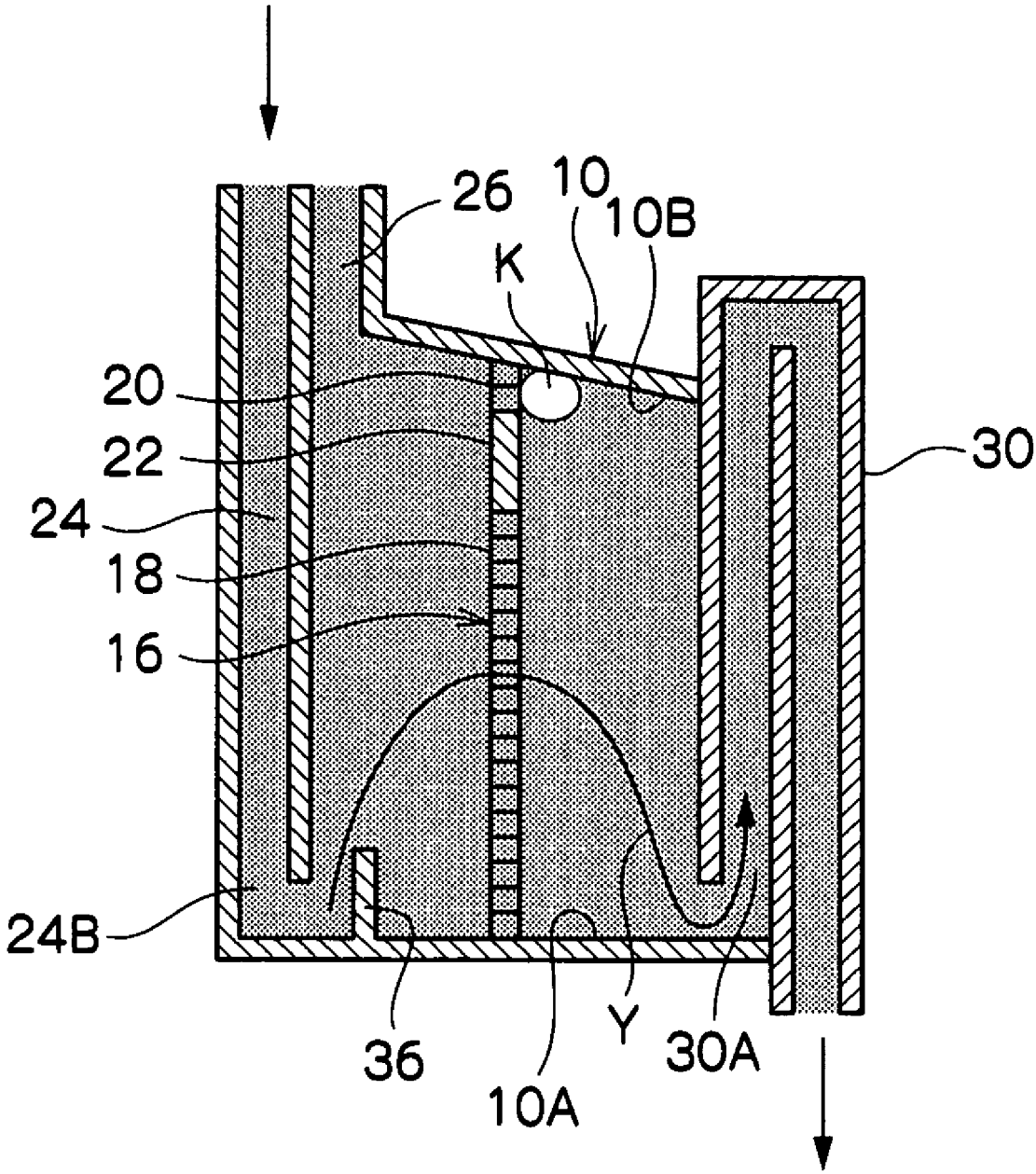
FIG. 4 is a drawing showing the flow of ink in the filter unit of FIG. 1 filled with ink.

As shown in FIG. 4, the sending channel entrance 30A of the ink sending channel 30 opens in the vicinity of the bottom 10A so the remaining air K is extremely far from the sending channel entrance 30A of the ink sending channel 30. For this reason, when there is ink-suctioning action and the like where ink is suctioned from the nozzles of the inkjet recording head 02, the air K remaining in the second ink chamber 14 almost never enters the ink sending channel 30 from the sending channel entrance 30A.

In this manner, there is very little air remaining in the filter unit 10 and also, there is hardly any air at all (i.e., bubbles) that flows out with the ink to the inkjet recording head 02. Accordingly, there is no deterioration of reliability which deterioration is caused by flowing out of the air stayed in the filter unit 10 and the air flowing into the inkjet recording head 02.

Further, it is better that the ink be sent from the first ink chamber 12 to the second ink chamber 14 by the ink passing through the filter 16 through the widest region possible. So with the present embodiment, an upward flow is generated in the flow of ink by the rectifier 36, as shown with the Y arrow, whereby the flow of ink to the sending channel entrance 30A of the ink sending channel 30 from the supply channel exit 24B of the ink supply channel 24 along the bottom 10A is prevented. The device is designed so that ink is sent to pass through the widest region of the filter 16 possible from the first ink chamber 12 to the second ink chamber 14.

FIG. 5 is a list where various conditions demanded of the filter unit (filter device) used in the inkjet recording head 02 (liquid droplet ejecting head) are summarized. Note that in the drawings, FU is an abbreviation for filter unit and JS is an abbreviation of inkjet recording head.

As is understood from this list, the conventional filter unit could not sufficiently fulfill some of the conditions from among the various conditions. In contrast, the filter unit 10 of the present embodiment can sufficiently fulfill all of these conditions and as a result, the reliability of the inkjet recording head 02 and the qualities thereof pertaining to maintenance are greatly improved.

Note that the entire ink sending channel 30 does not have to formed in an upside down U-shape, as described above. It can, for example, have an M-shape or some other shape.

Figure 6:
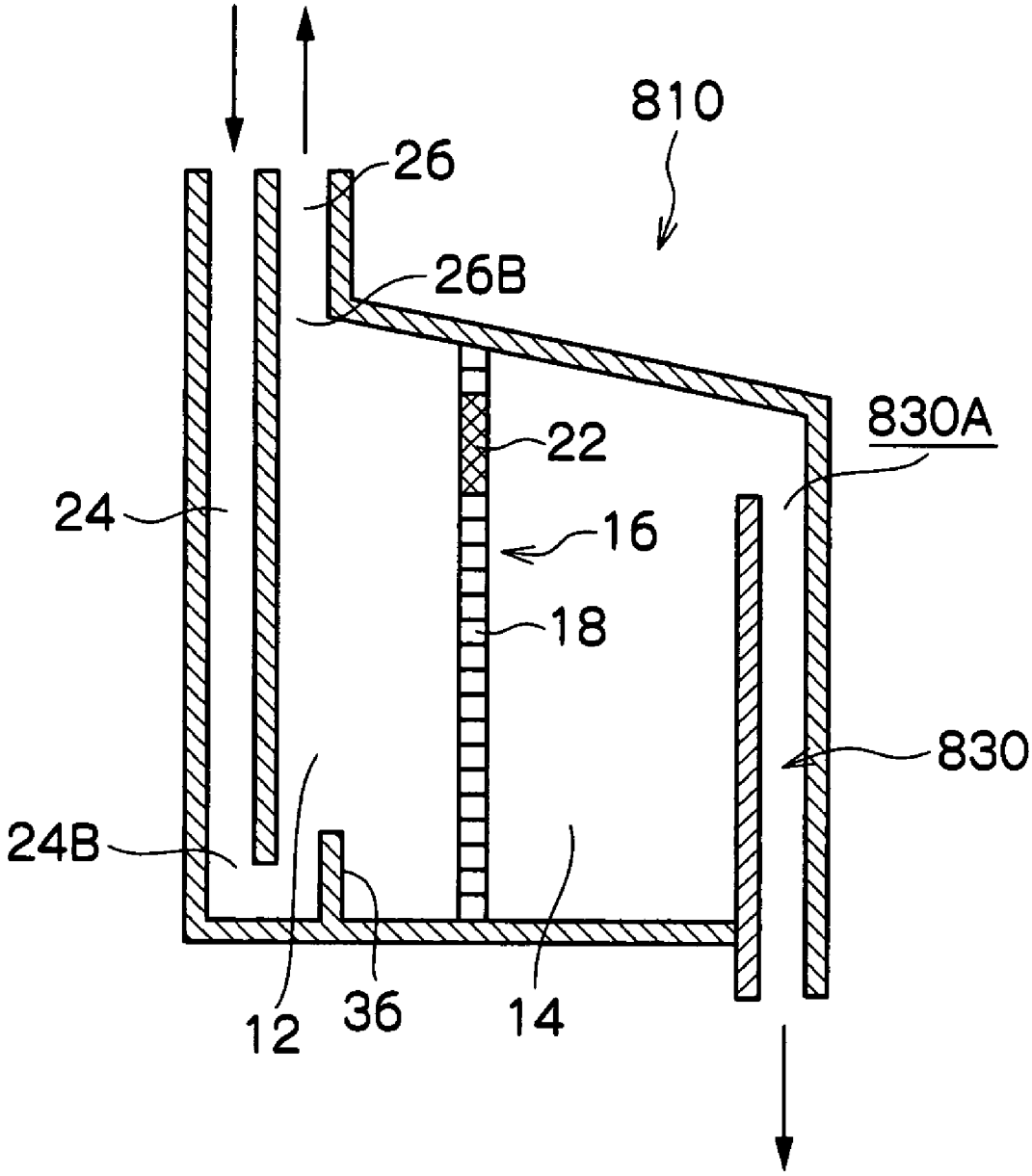
FIG. 6 is a drawing showing a first alternate example of a filter unit according to the first exemplary embodiment of the present invention.

Alternatively, as shown in, for example, as shown in FIG. 6, in a filter unit 810 of a first alternate example of the present embodiment, it can also be a straight-lined ink sending channel 830 where the upper portion becomes an opening 830A.

Note that with this kind of configuration, it may be easy for the air stayed in the ceiling portion vicinity of the second ink chamber 14 to be discharged with the ink from the ink sending channel 830. Nonetheless, as previously discussed, the accumulated air is markedly less than in the conventional device so its effects are extremely small.

Figure 7:
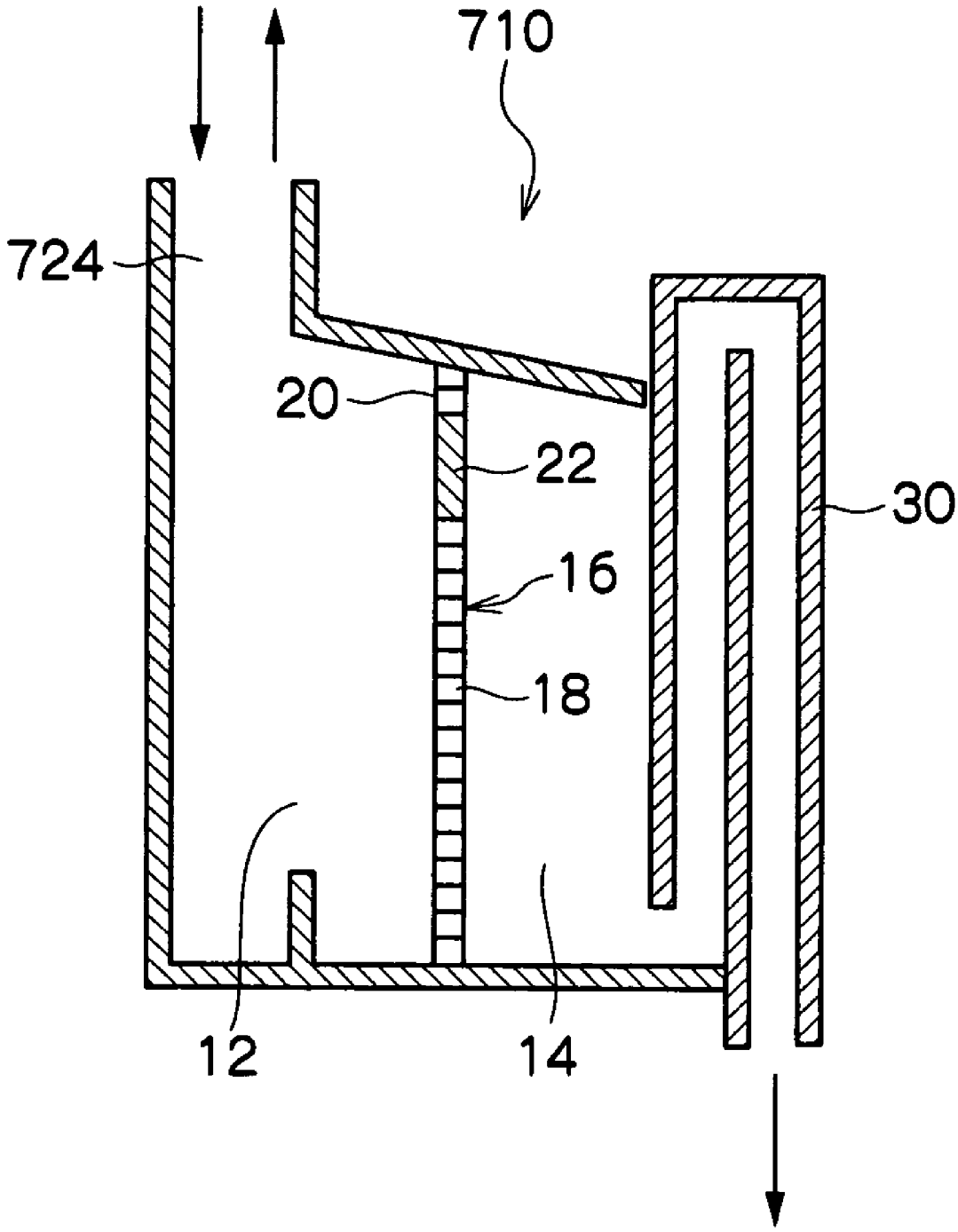
FIG. 7 is a drawing showing a second alternate example of a filter unit according to the first exemplary embodiment of the present invention.

Further, as is shown in FIG. 7, a filter unit 710 of a second alternate example of the present embodiment having no ink circulation channel 26 is also possible. In this case, discharging of the air of the first ink chamber 12 is performed from an ink supply channel 724.

Figure 20:
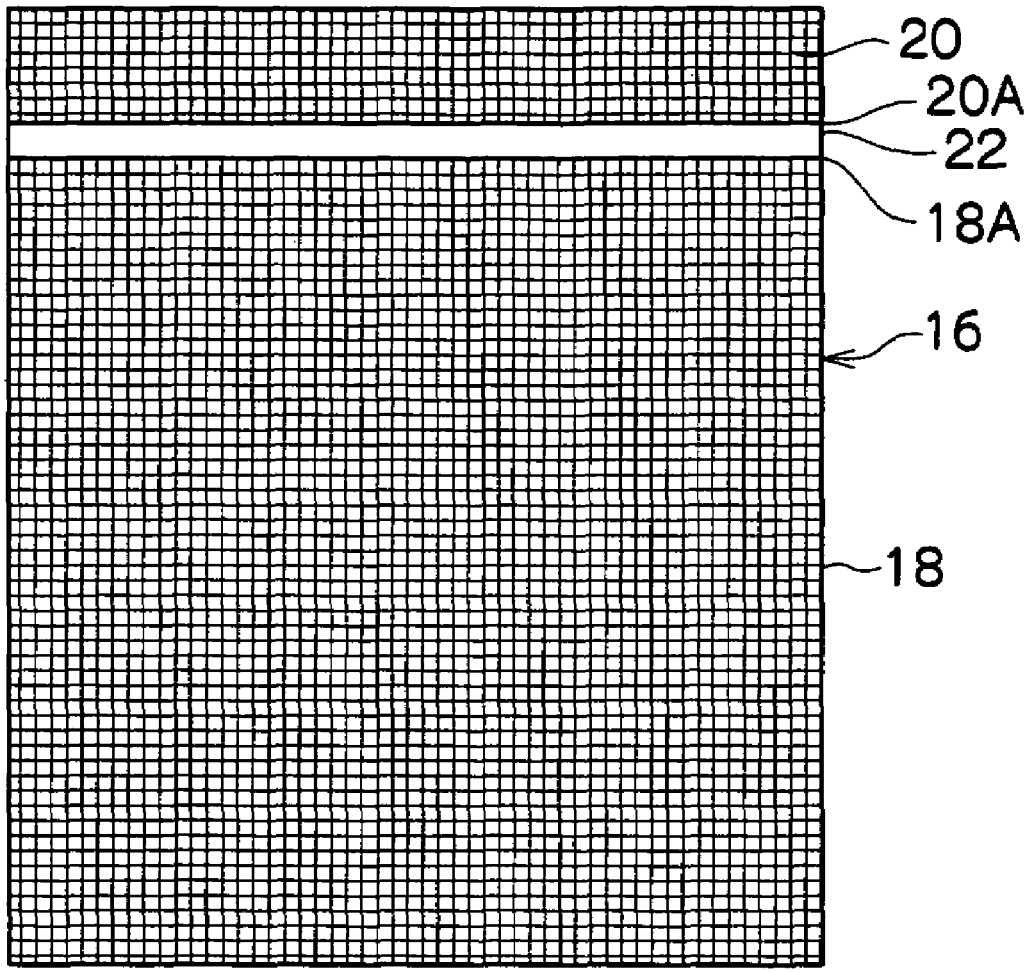
FIG. 20 is a frontal drawing of the filter according to the first exemplary embodiment of the present invention.
Figure 21B:
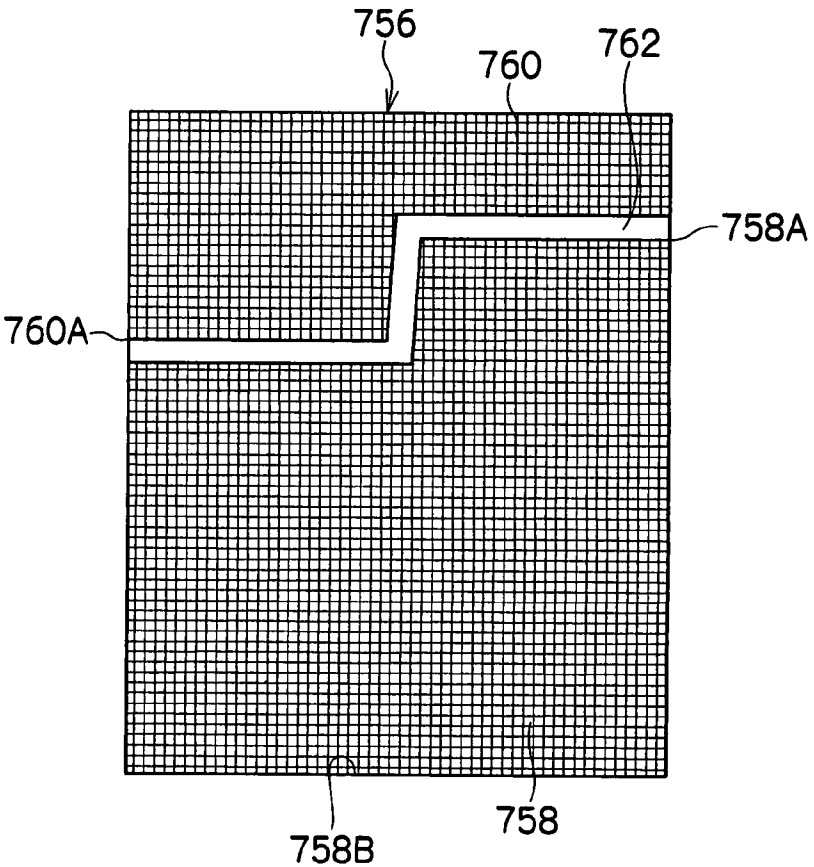
FIG. 21B is a frontal drawing of the filter of the fourth alternate example according to the first exemplary embodiment of the present invention.
Figure 21A:
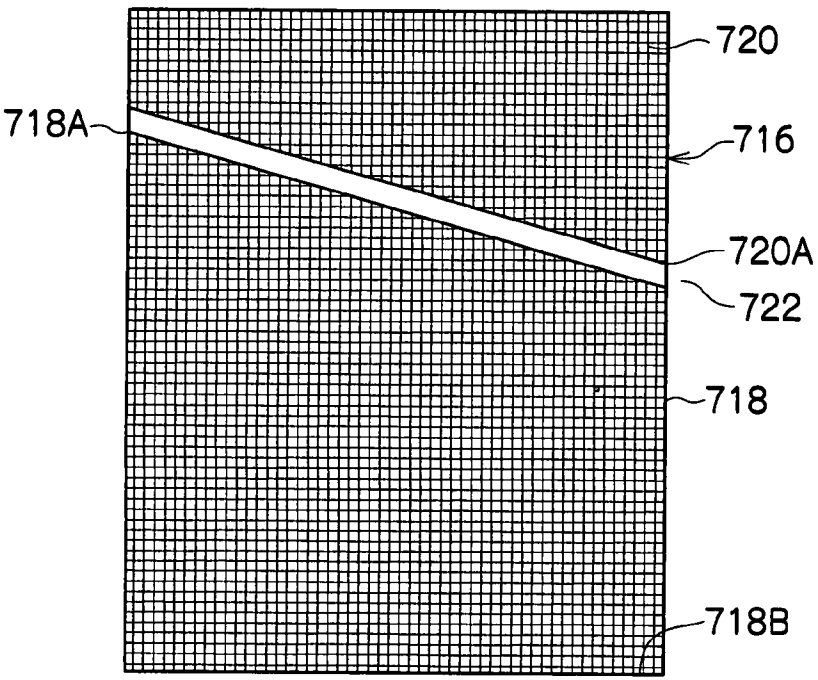
FIG. 21A is a frontal drawing of the filter of the third alternate example according to the first exemplary embodiment of the present invention.

Note that, as shown in FIG. 20 where the filter 16 is viewed from the front, the lower end 20A of the upper filter 20 in the filter 16 is higher up than the upper end 18A of the lower filter 18, however, this is not thus limited. For example, if lower ends (the lowermost ends) 720A, 760A of upper filters 720, 760 are set higher than lower ends 718B, 758B of lower filters 718, 758, as in a filter 716 of a third alternate example of the present embodiment shown in FIG. 21A (inclined divider 722) and a filter 756 of a fourth alternate example of the present embodiment shown in FIG. 21B (step-shaped divider 762), the lower ends (the lowermost ends) 720A, 760A of the upper filters 720, 760 can be lower than the upper ends (the uppermost ends) 718A, 758A of the lower filters 718, 758.

Next, a second exemplary embodiment of the present invention will be explained. Note that explanations on structural portions that are the same as in the first exemplary embodiment have been omitted.

In the first exemplary embodiment, the lower filter 18 and the upper filter 20 are arranged to line up from top to bottom on the same vertical surface (see FIG. 2).

In contrast, a filter unit 310 of the present embodiment has an upper filter 320 of a filter 316 arranged substantially horizontally.

A divider 322 is provided above an upper end 318A of a lower filter 318 and the upper filter 320 extends substantially horizontally from the upper end of the divider 322 and is connected to a ceiling 310B. That is, the upper filter 320 forms a portion of the ceiling of a second ink chamber 314 and the upper filter 320 forms the uppermost surface of the second ink chamber 314. Note that the lower filter 318 is provided so as to stand vertically from a bottom 310A. Also, the upper filter 320 is higher above than the upper end 318A of the lower filter 318.

Next, the operation of the present embodiment will be explained.

In the case of the first exemplary embodiment, when a state is achieved as in FIG. 3D, the upper filter 20 gets wet and the flow of air from the second ink chamber 14 to the first ink chamber 12 is blocked so air remains in the second ink chamber 14 in the triangular region S.

Figure 17:
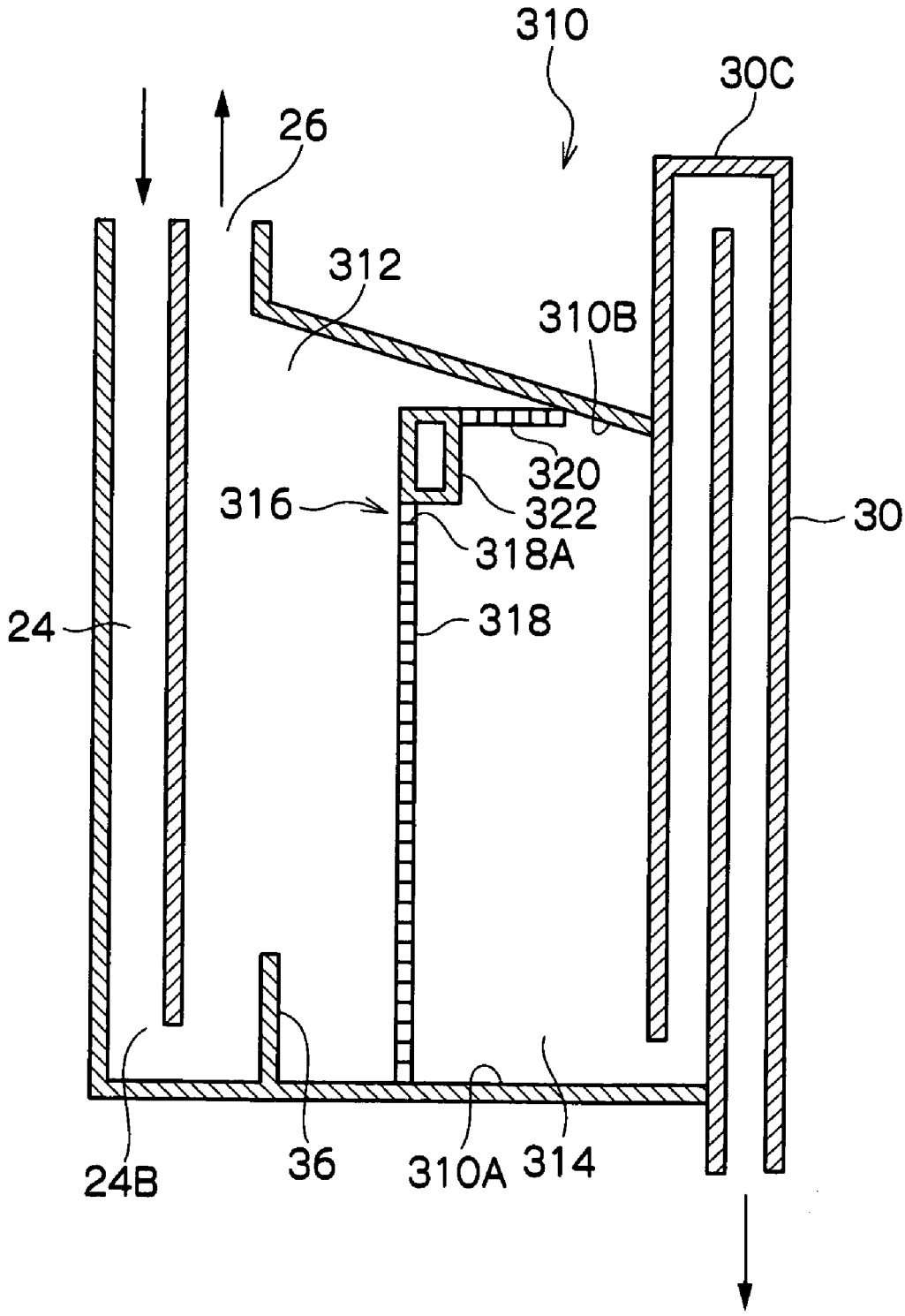
FIG. 17 is a drawing showing a typical structure of the filter unit according to the second exemplary embodiment of the present invention.

In contrast, in the case of the present embodiment as shown in FIG. 17, the liquid surface rises and the upper filter 320 gets wet so when the flow of air from the second ink chamber 314 to a first ink chamber 312 is blocked, the second ink chamber 314 is almost entirely full of ink so hardly any air remains in the second ink chamber 314. (In the present embodiment, the triangular region S in FIG. 3D is found is in the first ink chamber 312.)

Next, a third exemplary embodiment of the present invention will be explained. Note that explanations on structural components that are the same as in the first and second exemplary embodiments have been omitted.

Figure 18:
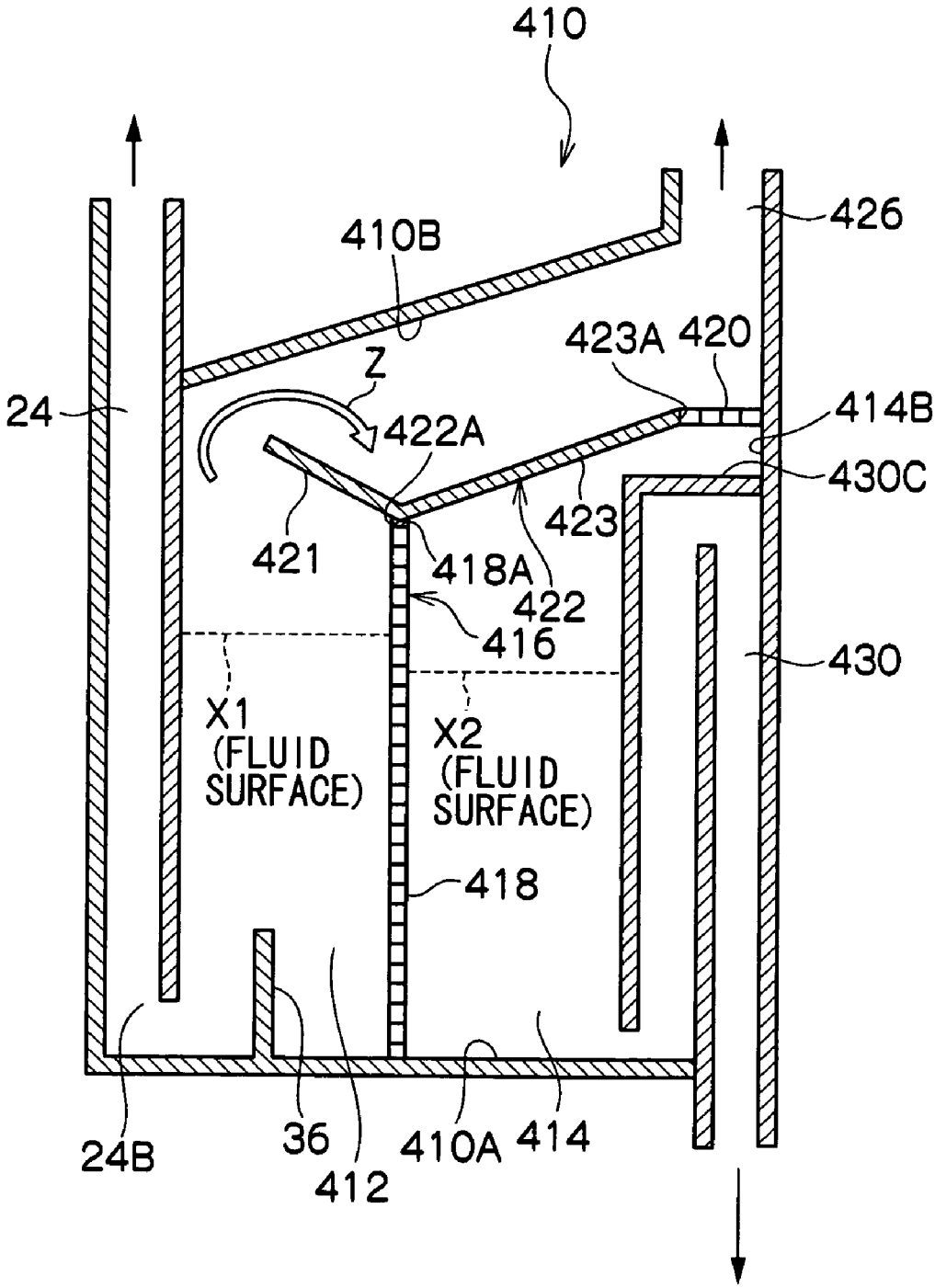
FIG. 18 is a drawing showing a typical structure of the filter unit according to the third exemplary embodiment of the present invention.

As shown in FIG. 18, a filter 416 of a filter unit 410 of the third exemplary embodiment has a divider 422 provided above a lower filter 418. The divider 422 has an approximate V-shape where the center portion thereof is depressed. An upper end 418A of the lower filter 418 is connected to a vertex portion 422A that is the lowest depressed portion of the divider 422. The divider 422 has a first divider 421 extending upwards at a slant from the vertex portion 422A to the side of the first ink chamber 412, and a second divider 423 extending upwards at a slant from the vertex portion 422A in the opposite direction. Also, an upper filter 420 extending substantially horizontally from an end portion 423A of the second divider 423 is connected to a side wall 414B.

Further, a ceiling 410B of the filter unit 410 is a slanted surface that rises upward at a slant towards the right side in the drawing (towards the side of the second ink chamber 414) and an ink circulation channel 426 connects with the peak (top) of this slanted surface. Hence, the upper filter 420 is positioned below this ink circulation channel 426.

Note that the inner side surrounded by the upper filter 420, second divider 423 and lower filter 418 becomes the second ink chamber 414 and the outer side becomes the first ink chamber 412. Further, the upper filter 420 forms the uppermost surface of the second ink chamber 414.

The lower filter 418 is provided so as to stand vertically from a bottom 410A, and the upper filter 420 is higher than the upper end 418A of the lower filter 418.

Note that a convex shaped top portion 430C of a U-shaped ink sending channel 430 is positioned below the upper filter 420.

Next, the operation of the present embodiment will be explained.

The first ink chamber 412 and the second ink chamber 414 gradually fill in a state where the levels of their liquid surfaces are maintained to be almost the same. However, since the area of the upper filter 420 is small, the air resistance is great. So it is accurate to state that, as shown with the dotted lines X1 and X2 in the drawing, the liquid surface X2 of the second ink chamber 414 is lower, only slightly, than the liquid surface X1 of the first ink chamber 412. Accordingly, in the case of the first exemplary embodiment, there may be a case where, although it depends on the width of the divider 22, the liquid surface of the first ink chamber 12 surpasses the divider 22 and contacts the upper filter 20 before the liquid surface of the second ink chamber 14 contacts the upper filter 20 (see FIG. 2).

In contrast, with the present embodiment, even if the liquid surface X1 of the first ink chamber 412 rises first, ink accumulates once inside the V-shaped depression of the divider 422, as shown with the Z arrow. So even if the liquid surface X2 of the second ink chamber 414 rises while being slightly behind the liquid surface X1, the liquid surface X2 of the second ink chamber 414 is the first to contact the upper filter 420.

Accordingly, the upper filter 420 is wet at the very end after the air is almost completely discharged from the second ink chamber 414 so almost no air at all remains in the second ink chamber 414.

Next, a fourth exemplary embodiment of the present invention will be explained. Note that explanations on structural components that are the same as in the first through third exemplary embodiments have been omitted.

Figure 19:
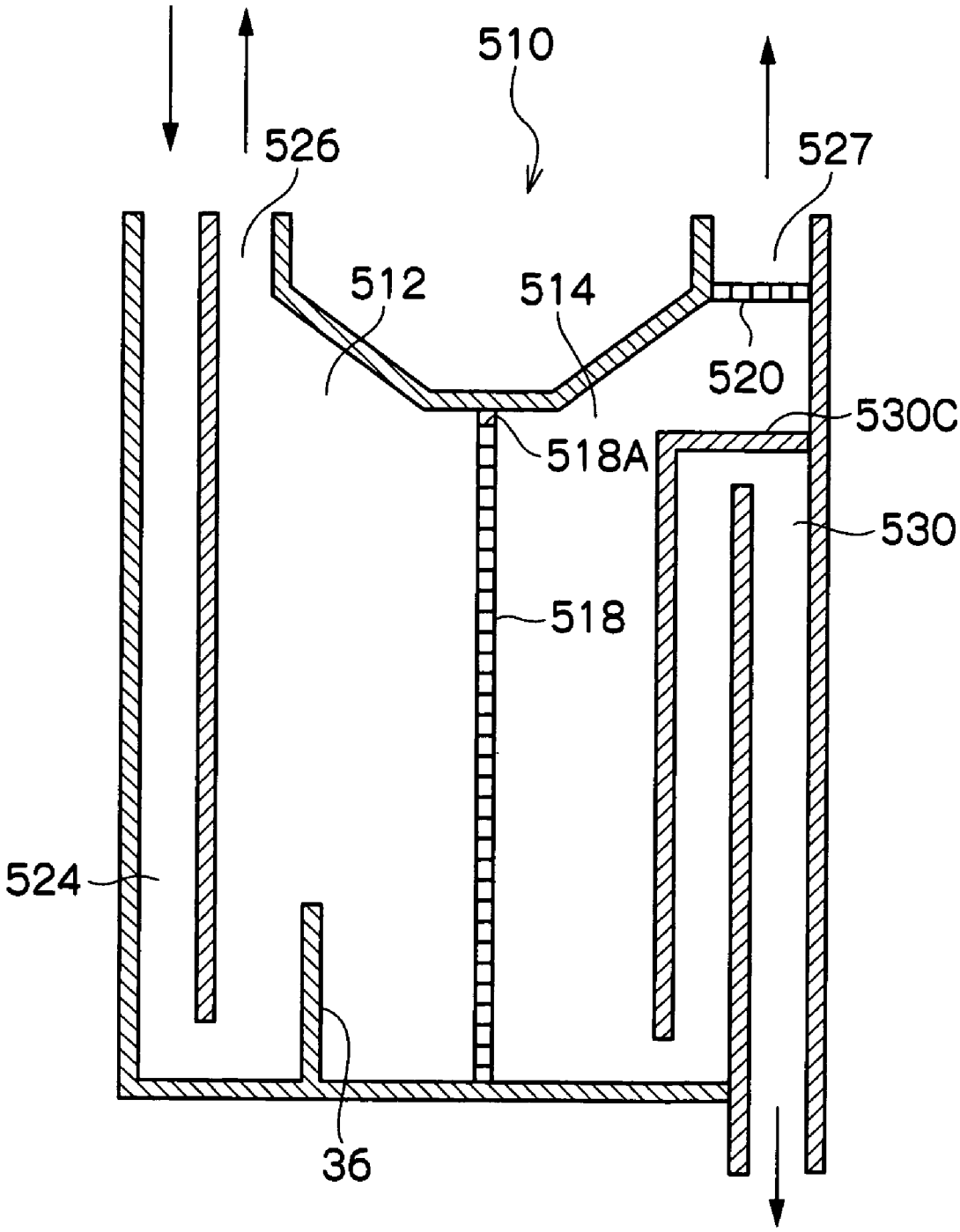
FIG. 19 is a drawing showing a typical structure of the filter unit according to the fourth exemplary embodiment of the present invention.

As shown in FIG. 19, an ink supply channel 524 and a first ink circulation channel 526 are communicated with a first ink chamber 512 of a filter unit 510 of the fourth exemplary embodiment. Also, an ink sending channel 530 is communicated with a second ink channel 514, and further, a second ink circulation channel 527 opens at the ceiling portion of the second ink channel 514.

A first filter 518 divides between the first ink chamber 512 and the second ink channel 514, and a second filter 520 is provided at the opening of the second ink circulation channel 527. The first filter 518 is arranged substantially vertically and the second filter 520 is arranged substantially horizontally. Further, the second filter 520 is higher above an upper end 518A of the first filter 518.

A convex shaped top 530C of the U-shaped ink sending channel 530 is positioned lower than the second filter 520.

Then the ink of an ink tank (not shown in the drawings) is supplied from the ink supply channel 524, and the ink is sent to the inkjet recording head 02 (see FIG. 1) from the ink sending channel 530 after passing through the first ink chamber 512, the first filter 518 and the second ink channel 514. Further, the ink of the first ink chamber 512 and the ink of the second ink channel 514 can circulate with the ink tank (not shown in the drawings) respectively through the first ink circulation channel 526 and second ink circulation channel 527.

Next, the operation of the present embodiment will be explained.

At the time when a liquid is first filled to the filter device, when ink flows into the first ink chamber 512 from the ink supply channel 524, the bottom end of the first filter 518 that separates the first ink chamber 512 from the second ink channel 514 is immersed in ink. When the bottom end of the first filter 518 becomes immersed in liquid ink, the ink soaks into the first filter 518 due to capillary force and spreads towards the upper portion thereof. Then, before the first ink chamber 512 and the second ink channel 514 become filled with the ink liquid, the entire surface of the first filter 518 enters a state where it is wet with ink.

For this reason, the air of the second ink channel 514 cannot move to the first ink chamber 512, however, the second filter 520 is not wet with ink. Accordingly, the air of the second ink channel 514 is discharged from the second ink circulation channel 527 through the second filter 520.

Then the liquid surface level of the second ink channel 514 and the liquid surface level of the first ink chamber 512 are maintained at substantially the same level and raised (or the liquid surface of the second ink channel 514 raised but lags slightly behind). The liquid surface reaches the second filter 520, which is the uppermost surface of the second ink channel 514, and the second filter 520 is wet. That is, after the air is almost completely discharged from the second ink channel 514, lastly, the second filter 520 is wet so almost no air at all remains in the second ink channel 514.

Note that when there is reverse flow in the second ink circulation channel 527, the second filter 520 can also be used for filtration.

Next, examples of the present invention will be explained. Note that, although the following examples have configurations applied to the above-described first exemplary embodiment, these can also be applied to the second through fourth exemplary embodiments.

First Example

Figure 8:
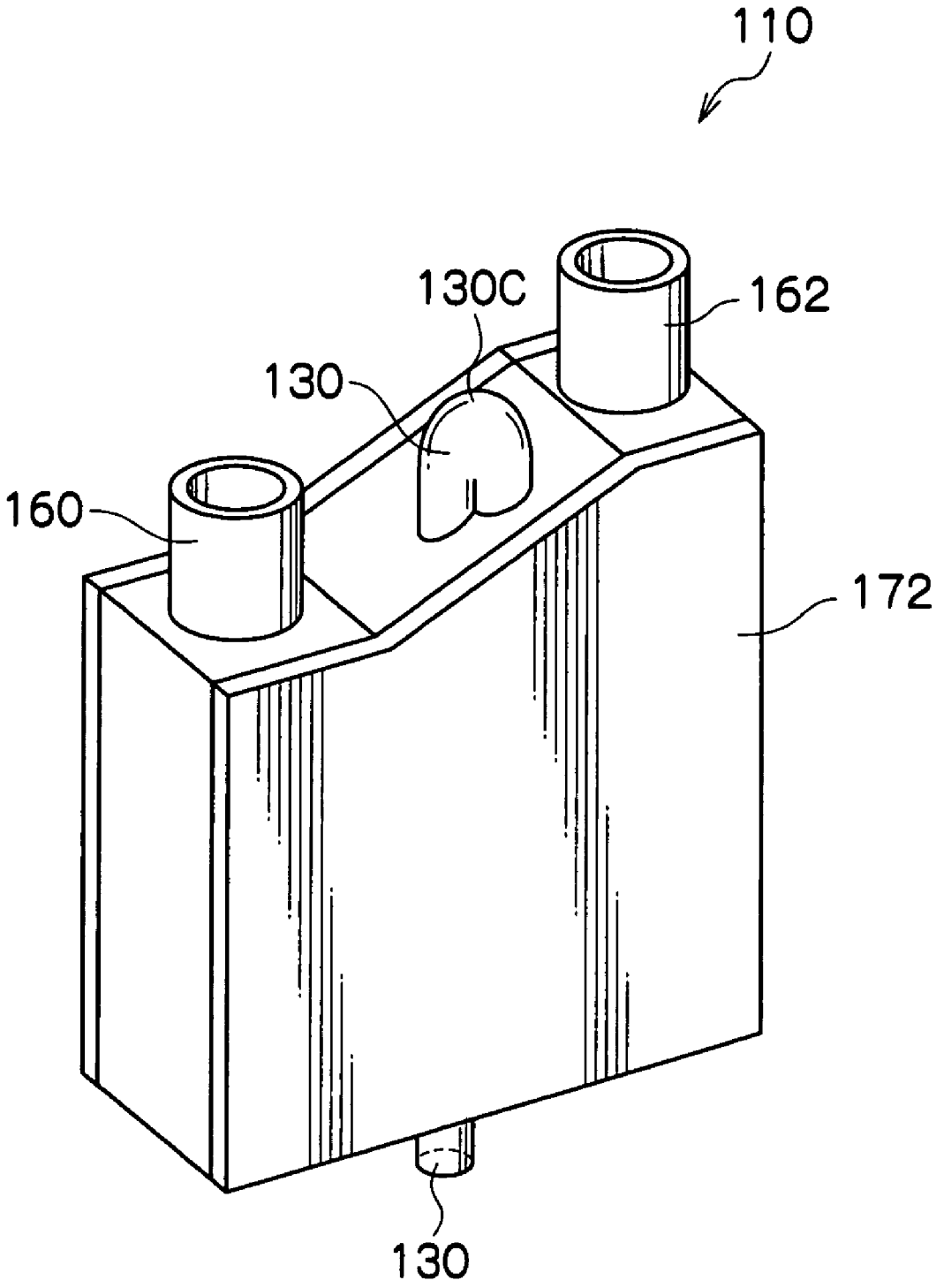
FIG. 8 is a perspective drawing showing the exterior of the filter unit of the first example.

As shown in FIG. 8, the entire body of a filter unit 110 of the first example has a flat, substantially trapezoidal box shape. The filter unit 110 is made into a unit where each of the structural components is integrally assembled. Then, in its unit-assembled state, it is used in a state where connected in the ink channel between the inkjet recording head and the ink cartridge installed in the inkjet recording device.

Figure 9:
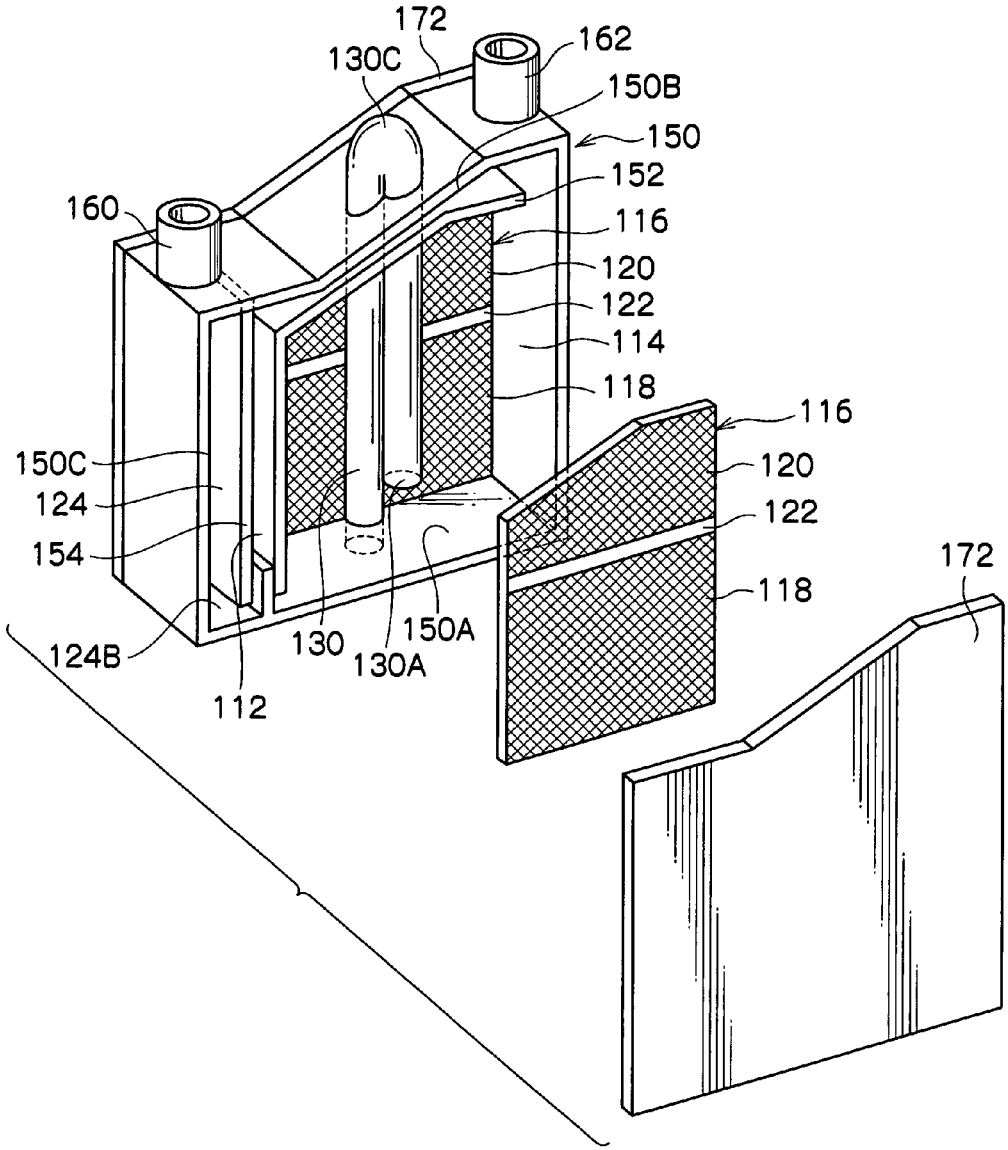
FIG. 9 is an exploded perspective view showing the filter unit of FIG. 8 in an exploded state.

As shown in FIG. 9, the filter unit 110 includes a case main body 150, two side panel components 172 and two filters 116.

Both side surfaces of the case main body 150 open and the interior thereof is hollow. The left portion and right portion of the upper surface of the case main body 150 are each substantially horizontal surfaces and the right portion is a little higher than the left portion. Also, there is an inclined surface between this left portion and right portion that slants upwards from the left side to the right side.

A barrier 152 having preset intervals from a ceiling 150B and a front inner wall surface 150C is formed in the interior of the case main body 150. The width of this barrier 152 is narrower than the width of the case main body 150. The filters 116 are attached to this barrier 152 so the two filters 116 are arranged to face each other and be substantially parallel. Also, side panel components 172 are attached at both side surfaces of the case main body 150. Note that in FIG. 9, the device is in a state where the filter 116 and side panel component 172 of one side only are attached.

Figure 10B:
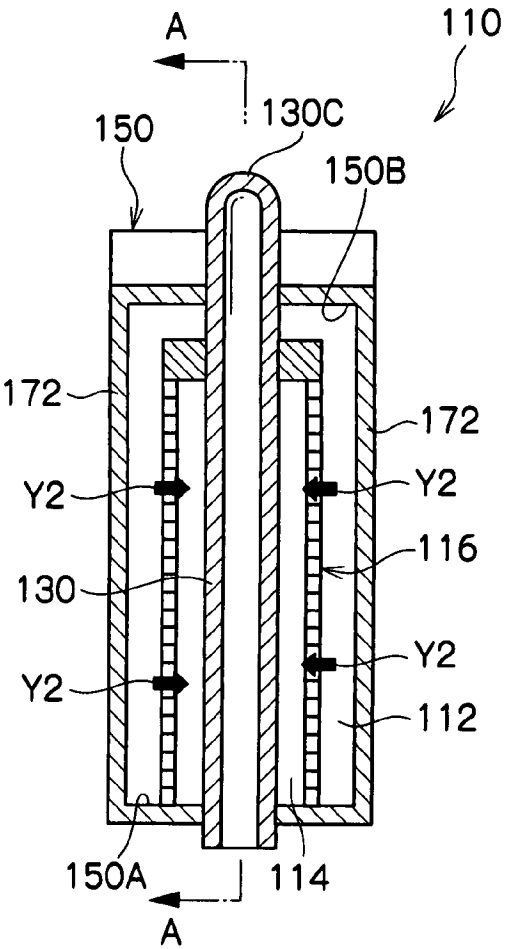
FIGS. 10A and 10B are cross-sectional drawings showing the cross section of the filter unit of FIG. 8, where
Figure 10A:
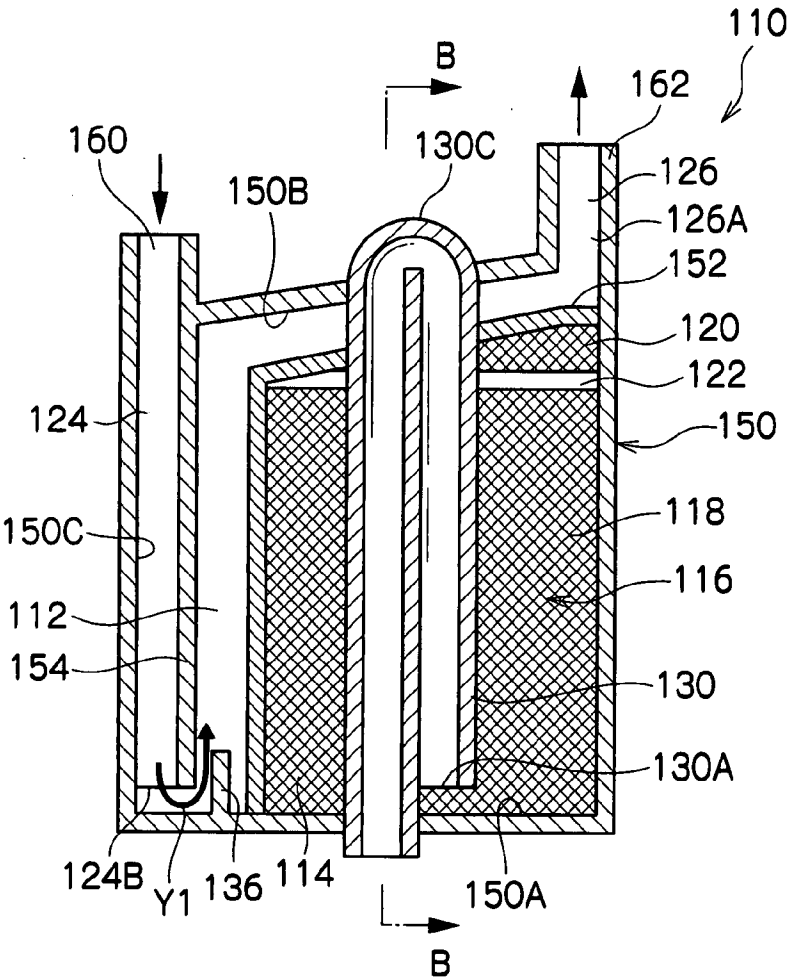

The device is configured in this manner so, as shown in FIG. 10, an inner chamber 114 sandwiched between the filters 116 is formed and an outer chamber 112 is formed at the outer side of the inner chamber. That is, the inner chamber 114 is configured to be sandwiched by the outer chamber 112. Also, the filters 116 are configured so as to be provided at the boundary phases of the inner chamber 114 and outer chamber 112. Note that the outer chamber 112 corresponds to the first ink chamber 12 explained in the above-described embodiments and the inner chamber 114 corresponds to the second ink chamber 14 (refer to FIG. 1).

Note that the filter 116 includes an upper filter 120 and a lower filter 118 and a divider 122 that divides them.

A barrier 154 is provided between the frontal portion of the barrier 152 and the front inner wall surface 150C. This barrier 154 hangs down from the ceiling 150B and is formed so that a space is created between its bottom end and a bottom 150A. Further, the width of this barrier 154 is the same as the width of the case main body 150. The space between this barrier 154 and the front inner wall surface 150C is an ink supply channel 124 and a supply channel exit 124B is a space between the bottom end of the barrier 154 and the bottom 150A.

A rectifier 136 is also provided between the barrier 152 and the barrier 154. This rectifier 136 is provided to stand from the bottom 150A and the upper end is positioned to be higher than the supply channel exit 124B.

A cylindrical pipe 160 protrudes from the left portion of the upper surface of the case main body 150. This pipe 160 is communicated with the ink supply channel 124.

A cylindrical pipe 162 is also provided so as to protrude from the right portion of the upper surface of the case main body 150. This pipe 162 opens at the ceiling 150B and the pipe 162 is an ink circulation channel 126, and the opening of the ceiling 150B is a circulation channel entrance 126A.

An ink sending channel 130, which is a pipe bent into a reverse U-shaped form, is arranged substantially in the center vicinity of the inner chamber 114. A sending channel entrance 130A that is one end of the ink sending channel 130 opens at slightly higher position than the bottom 150A. The other end of the ink sending channel 130 goes through the bottom 150A, protrudes, and is connected to the inkjet recording head (not shown in the drawings). Further, a convex shaped portion of the ink sending channel 130 goes through the ceiling 150B and protrudes. Accordingly, the height of the convex shaped top portion 130C of the ink sending channel 130 (i.e., the uppermost position of the ink sending channel 130) is higher than the circulation channel entrance 126A of the ink circulation channel 126.

Note that the cross-sectional area of the ink supply channel 124, ink circulation channel 126 and ink sending channel 130 is 4.9 $mm^2$ (the ink sending channel 130 is a circular pipe channel with an inner diameter of 2.5 mm), and the meniscus of the ink that flows here is stabilized and maintained.

Next, although this may overlap with the exemplary embodiments, the flow of ink of the filter unit 110 will be explained.

Ink from an ink tank (not shown in the drawings) is sent from the pipe 160 to the ink supply channel 124. The ink comes out from the supply channel exit 124B of the ink supply channel 124. It is changed to an upward flow with the rectifier 136 (refer to the Y1 arrow in FIG. 10A). Then ink fills into the inner chamber 114 and the outer chamber 112. At this time, when the bottom end of the filter 116 that isolates the inner chamber 114 from the outer chamber 112 becomes immersed in ink, the ink soaks into the filter due to capillary force and spreads towards the upper portion thereof. However, the filter 116 includes the upper filter 120 and the lower filter 118 and the divider 122 is provided between them. Accordingly, the lower filter 118 is soaked with ink, however, the soaking and spreading of the ink is stopped at the divider 122 so the upper filter 120 is maintained in a state where it is not wet. For this reason, air can enter and exit between the inner chamber 114 and outer chamber 112 through the upper filter 120, so the air inside the inner chamber 114 is discharged from the ink circulation channel 126 via the outer chamber 112. (This corresponds to FIGS. 3A and 3B of the exemplary embodiment.)

Accordingly, the inner chamber 114 and the outer chamber 112 gradually fill in a state where the same level of liquid surfaces is maintained. Also, ink fills the ink sending channel 130 such that the interior thereof is also in a state where a liquid surface level that is substantially the same as that of the inner chamber 114 and the outer chamber 112 is maintained. (This corresponds to FIG. 3C of the exemplary embodiment.)

When the liquid surface of the ink surpasses the divider 122 and reaches the bottom end of the upper filter 120, the ink soaks into the filter due to capillary action and spreads towards the upper portion of the upper filter 120. Before the inner chamber 114 and outer chamber 112 are filled with ink, the entire surface of the upper filter 120 is in a state where it is wet with ink. It is at this time that the flow of air between the inner chamber 114 and the outer chamber 112 is blocked for the first time. (This corresponds to FIG. 3D of the exemplary embodiment.)

However, the inner chamber 114 is already sufficiently filled with ink at this time and the amount of air remaining in the inner chamber 114 is extremely small. (This corresponds to FIG. 3E of the exemplary embodiment.)

When the outer chamber 112 and inner chamber 114 are filled with ink, the supplying of ink from the ink sending channel 130 to the inkjet recording head is initiated. At this time, the cross-sectional area of the ink sending channel 130 is 4.9 $mm^2$ (with an inner diameter of 2.5 $mm^2$) so the ink is sent with the ink meniscus maintained as is. For this reason, ink is injected into the inkjet recording head in a state where almost no air is mixed therein. (This corresponds to FIG. 3F of the exemplary embodiment.) Further, only a very small amount of air remains in the inner chamber 114. (This corresponds to FIGS. 3G and 3H of the exemplary embodiment.)

Also, the sending channel entrance 130A of the ink sending channel 130 opens at the vicinity of the bottom 150A, so the air remaining in the vicinity of the ceiling 150B of the inner chamber 114 is extremely far from the sending channel entrance 130A of the ink sending channel 130. For this reason, when there is ink-suctioning action and the like where ink is suctioned from the nozzles of the inkjet recording head, there are hardly no instances where the remaining air enters the ink sending channel 130 from the sending channel entrance 130A.

Further, by configuring the device so that the inner chamber 114 is sandwiched inside the outer chamber 112, the area of the filter 116 can be made larger.

Second Example

Figure 11:
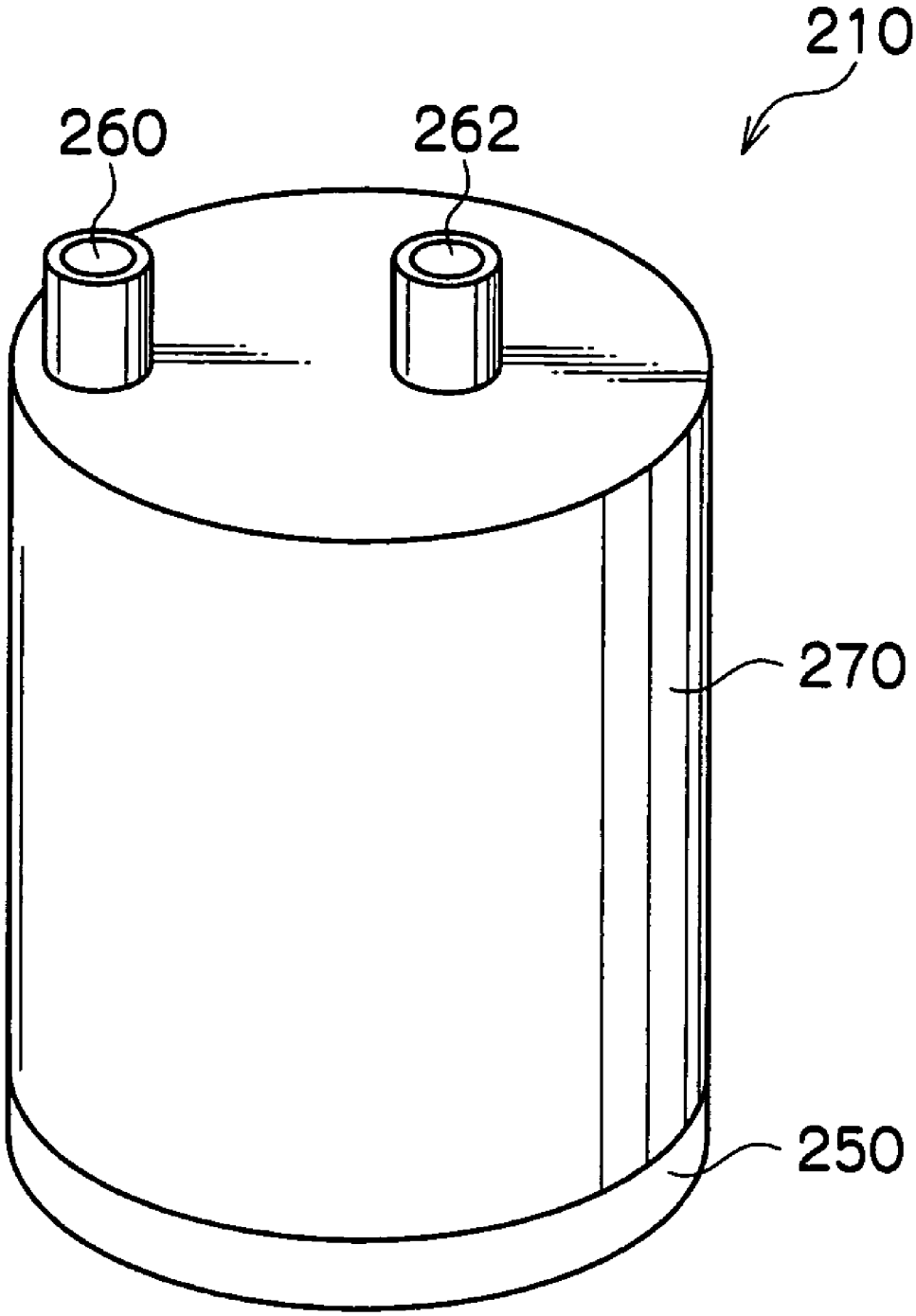
FIG. 11 is a perspective drawing showing the exterior of the filter unit of the second example.

As shown in FIG. 11, the entire body of a filter unit 210 of the second example has a cylindrical shape. Also, like in the first example, the filter unit 210 is made into a unit where each of the structural components is integrally assembled. Then, in its unit-assembled state, it is used in a state where connected in the ink channel between the inkjet recording head and the ink cartridge set in the inkjet recording device.

Figure 12:
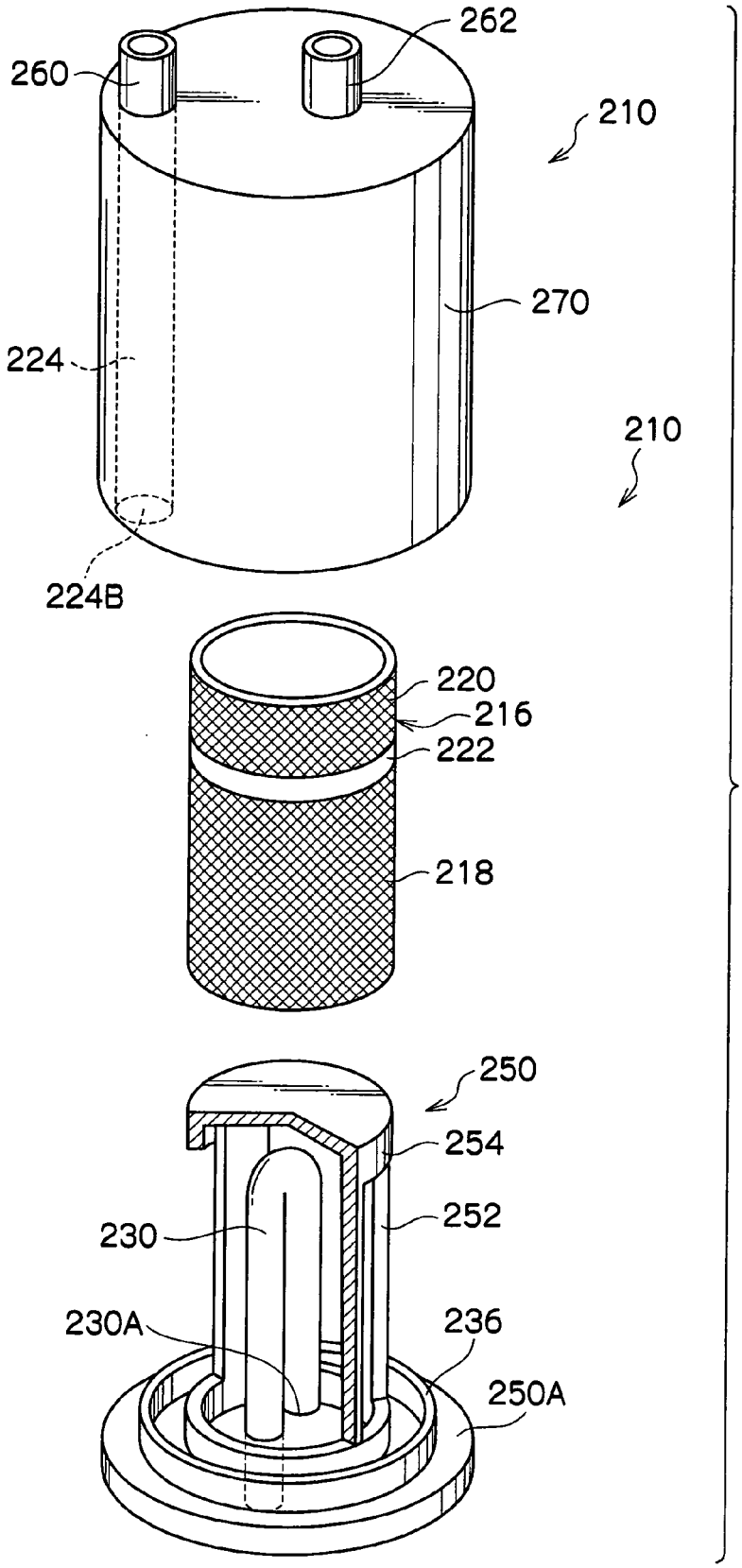
FIG. 12 is an exploded perspective view showing the filter unit of FIG. 11 in an exploded state.

As shown in FIGS. 12 and 13, the filter unit 210 is made up of a cover component 270, a case main body 250 and a filter 216.

The lower portion of the cover component 270 is circularly opened and the interior of the cover component 270 is cylindrical and hollow. A pipe 260 and a pipe 262 are provided on the upper portion of the cover component 270 so as to protrude. The pipe 260 extends into the interior of the cover component 270 and the pipe 260 is an ink supply channel 224, and the opening of the pipe 260 is a supply channel exit 224B. Further, the pipe 262 is an ink circulation channel 226 and the opening of a ceiling 270B is a circulation channel entrance 226A.

The case main body 250 is provided with a disk-shaped bottom 250A. A circular cylinder 254 in which plural longitudinal quadrilateral openings 252 are formed in the side surface thereof is provided in the bottom 250A. Note that the upper portion of this circular cylinder 254 is lower than the ceiling 270B of the cover component 270.

An ink sending channel 230, which is a pipe bent into a reverse U-shaped form, is arranged inside the circular cylinder 254. A sending channel entrance 230A that is one end of the ink sending channel 230 opens at slightly higher position than the bottom 250A. The other end of the ink sending channel 230 goes through the bottom 250A, protrudes, and is connected to the inkjet recording head (not shown in the drawings). Further, a concentrically circular rectifier 236 is provided so as to stand from the bottom 250A at the outer side of the circular cylinder 254.

Then, after attaching the filter 216 to the surroundings of the circular cylinder 254, the cover component 270 is placed on the case main body 250 and joined thereto.

By assembling the device in this manner, an inner chamber 214 inside the circular cylinder 254 is configured to be inside an outer chamber 212 between the circular cylinder 254 and the cover component 270. Note that the inner chamber 214 corresponds to the second ink chamber 14 of the exemplary embodiment and the outer chamber 212 corresponds to the first ink chamber 12 of the exemplary embodiment.

Note that the filter 216 that partitions the inner chamber 214 and the outer chamber 212 includes an upper filter 220 and a lower filter 218 and a divider 222 that divides them.

Explanations regarding the flow of ink are omitted since these are the same as in the exemplary embodiments and the first example.

Figure 13A:
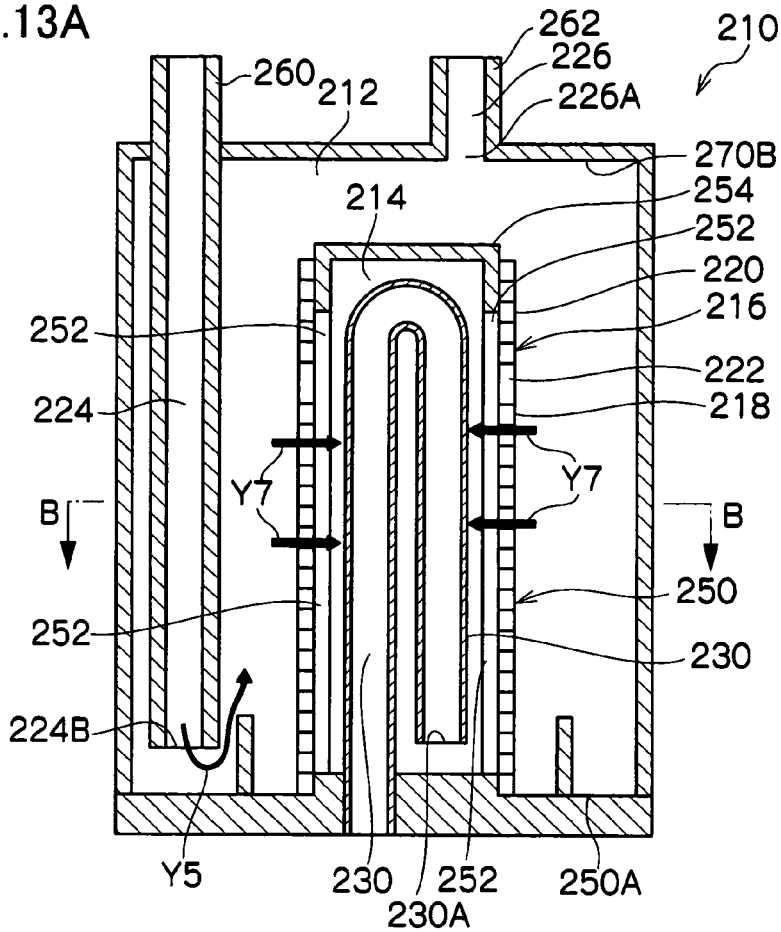
FIGS. 13A and B are cross-sectional drawings showing the cross section of the filter unit of FIG. 11, where
Figure 13B:
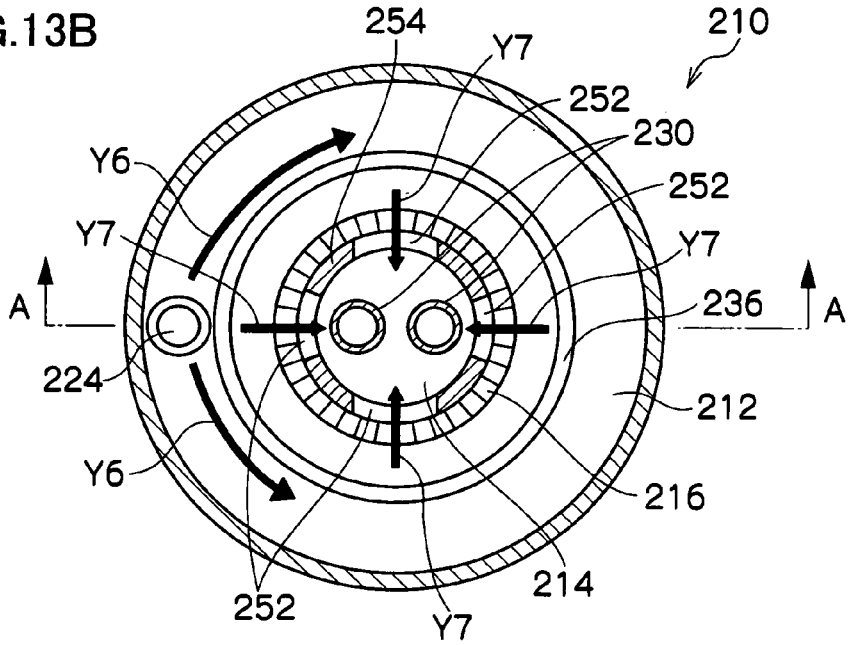
FIG. 13B is a cross-sectional drawing B-B from FIG. 13A.

Note that since the device is configured in this manner, the ink of the ink supply channel 224 generates an upward flow by the rectifier 236, as shown with the Y5 arrow in FIG. 13A, and, as shown with the Y6 arrow in FIG. 13B, ink flows across the entire periphery of the outer chamber 212. Further, as shown with the Y7 arrow, the ink flows through the filter 216 from the openings 252 and to the inner chamber 214.

Also, since the device is cylindrical, the flow speed of the ink that flows from the outer chamber 212 through the filter 216 and into the inner chamber 214, and goes towards the ink sending channel 230 is the same in any directions. Due to this, stagnant portions generated when ink flows become less and the ability to discharging air becomes good.

It should be noted that the present invention is not limited to the above-described exemplary embodiments and the examples.

For example, the filter device is not limited to an inkjet recording device. It can also be used to other liquid droplet ejecting devices such as a pattern forming device that ejects liquid droplets in order to form patterns on semiconductors and the like.

What is claimed is:

1. A filter device comprising:

a supply channel where a liquid flows in;

a first liquid chamber that is communicated with the supply channel;

a second liquid chamber that is communicated with the first liquid chamber;

a first discharge channel that is communicated with the second liquid chamber and that discharges the liquid;

a first filter that is provided between the first liquid chamber and the second liquid chamber;

a second filter that is provided between the first liquid chamber and the second liquid chamber and whose lower end is positioned higher than a lower end of the first filter; and a partition portion that is provided between the first filter and the second filter to separate the first filter and the second filter.

2. The filter device of claim 1, wherein the lower end of the second filter is positioned higher than an upper end of the first filter.

3. The filter device of claim 1, wherein the first filter and the second filter are arranged on the same plane.

4. The filter device of claim 1, wherein the second liquid chamber includes a plurality of surfaces that are communicated with the first liquid chamber, the first filter is provided at one of the plurality of surfaces of the second liquid chamber, and the second filter is provided at a surface that differs from the surface at which the first filter is provided.

5. The filter device of claim 1, wherein the second filter forms the uppermost surface of the second liquid chamber.

6. The filter device of claim 1, wherein the second filter is arranged horizontally.

7. The filter device of claim 1, wherein a midpoint of the first discharge channel between an entrance and an exit of the first discharge channel is positioned higher than the entrance and the exit, and the entrance of the first discharge channel opens in the vicinity of the bottom of the second liquid chamber.

8. The filter device of claim 1 further comprising a third discharge channel that is communicated with the first liquid chamber.

9. The filter device of claim 8, wherein an entrance of the third discharge channel opens at a ceiling of the first liquid chamber or in the vicinity of the ceiling.

10. The filter device of claim 1, wherein an exit of the supply channel opens in the vicinity of a bottom of the first liquid chamber.

11. The filter device of claim 1, wherein the cross-sectional area of the first discharge channel is 3 $mm^2$ or more and 12 $mm^2$ or less.

12. The filter device of claim 1, wherein the second liquid chamber is provided at the inner side of the first liquid chamber.

13. The filter device of claim 1, wherein the first liquid chamber is provided so as to surround the exterior side surface of the second liquid chamber, and the first filter is provided along the exterior side surface.

14. The filter device of claim 1, wherein the second liquid chamber and the first filter are made to have cylindrical forms, and the first discharge channel is provided at a substantially axial center position of the cylindrical first filter.

15. The filter device of claim 1, wherein the first liquid chamber is provided so as to sandwich the second liquid chamber, and the first filter is provided at a boundary surface of the first liquid chamber and the second liquid chamber.

16. The filter device of claim 1, wherein the partition portion is provided between the first filter and the second filter at a heightwise position in the vicinity of a lower surface of a ceiling of the first liquid chamber or the second liquid chamber.

17. The filter device of claim 1, wherein the partition portion blocks proceeding of the liquid from the first filter to the second filter.

18. A filter device comprising:

a supply channel where a liquid flows in;

a first liquid chamber that is communicated with the supply channel;

a second liquid chamber that is communicated with the first liquid chamber;

a first discharge channel that is communicated with the second liquid chamber and that discharges the liquid;

a second discharge channel that is communicated with the second liquid chamber and that is provided higher than the first discharge channel;

a first filter that is provided between the first liquid chamber and the second liquid chamber; and a second filter that is provided between the second liquid chamber and the second discharge channel and whose lower end is positioned higher than a lower end of the first filter;

the lower end of the second filter being positioned higher than an upper end of the first filter.

19. The filter device of claim 18, wherein the second discharge channel opens at a ceiling of the second liquid chamber or in the vicinity of the ceiling.

20. A liquid droplet ejecting device comprising:

a liquid droplet ejecting head that ejects liquid droplets from nozzles towards an object to be ejected;

a liquid storage unit that stores a liquid supplied to the liquid droplet ejecting head; and a filter device that is provided between the liquid droplet ejecting head and the liquid storage unit, the filter device comprising:

a supply channel where the liquid flows in;

a first liquid chamber that is communicated with the supply channel;

a second liquid chamber that is communicated with the first liquid chamber;

a first discharge channel that is communicated with the second liquid chamber and that discharges the liquid;

a first filter that is provided between the first liquid chamber and the second liquid chamber;

a second filter that is provided between the first liquid chamber and the second liquid chamber and whose lower end is positioned higher than a lower end of the first filter; and a partition portion that is provided between the first filter and the second filter to separate the first filter and the second filter.

21. The liquid droplet ejecting device of claim 20, wherein the first filter is arranged to be substantially perpendicularly to a nozzle surface of the liquid droplet ejecting head in which the nozzles are formed.

* * * * *